US007752863B2

(12) United States Patent
Kim et al.

(10) Patent No.: US 7,752,863 B2
(45) Date of Patent: Jul. 13, 2010

(54) AIR CONDITIONER

(75) Inventors: Moon Shin Kim, Changwon-si (KR); Jong Ho Lee, Kimhae-si (KR)

(73) Assignee: LG ELectronics Inc., Seoul (KR)

( * ) Notice: Subject to any disclaimer, the term of this patent is extended or adjusted under 35 U.S.C. 154(b) by 255 days.

(21) Appl. No.: 11/819,738

(22) Filed: Jun. 28, 2007

(65) Prior Publication Data

US 2008/0000253 A1 Jan. 3, 2008

(30) Foreign Application Priority Data

Jul. 3, 2006 (KR) ..... 10-2006-0061890
Jul. 3, 2006 (KR) ..... 10-2006-0061891
Nov. 6, 2006 (KR) ..... 10-2006-0109157

(51) Int. Cl.
*F25D 21/14* (2006.01)

(52) U.S. Cl. ..... 62/291; 62/285; 62/286; 62/287; 62/288; 62/290

(58) Field of Classification Search ..... 62/272, 62/280, 288, 290, 291, 285, 286
See application file for complete search history.

(56) References Cited

U.S. PATENT DOCUMENTS 1,993,841 A * 3/1935 House ..... 40/473
2,824,429 A * 2/1958 Zucker ..... 62/427
2,945,357 A * 7/1960 MacLeod ..... 62/262
3,907,050 A * 9/1975 Mullings ..... 138/157
4,570,814 A * 2/1986 Seeley ..... 220/4.28
6,540,461 B1 * 4/2003 Hawang ..... 411/48
2003/0154736 A1 * 8/2003 Lloyd et al. ..... 62/291
2004/0222226 A1 * 11/2004 Gottainer et al. ..... 220/284

FOREIGN PATENT DOCUMENTS

| | | |
|---|---|---|
| CN | 2493877 | 5/2002 |
| CN | 2575527 | 9/2003 |
| CN | 1544851 | 11/2004 |
| EP | 0 534 805 | 3/1993 |
| EP | 1 248 049 | 10/2002 |
| FR | 2 731 777 | 9/1996 |
| JP | 6241484 | 8/1994 |
| JP | 9-287771 | 11/1997 |

* cited by examiner

*Primary Examiner*—Thomas E. Denion
*Assistant Examiner*—Michael Carton
(74) *Attorney, Agent, or Firm*—McKenna Long & Aldridge LLP

(57) ABSTRACT

An air conditioner is provided. The air conditioner includes a front frame, a rear frame, a main drain pan, and a base pan. The front frame provides a front portion, and the rear frame provides a rear portion. The main drain pan divides a space between the rear frame and the front frame, and the base pan provides a bottom portion. The front frame is coupled to the rear frame, the base pan, and the main drain pan.

19 Claims, 21 Drawing Sheets

AIR CONDITIONER

This application claims the benefit of Korean Patent Application No. 10-2006-0061890, filed on Jul. 3, 2006, and Korean Patent No. 10-2006-0061891, filed on Jul. 3, 2006, and Korean Patent Application No. 10-2006-0109157 filed on Nov. 6, 2006, which are hereby incorporated by reference for all purposes as if fully set forth herein.

BACKGROUND OF THE INVENTION

1. Field of the Invention

The present invention relates to an air conditioner, and more particularly, to an air conditioner having a solid structure that allows a main drain pan as well as a rear frame pan and a base pan to be directly coupled to a front frame, and that is easily moved.

2. Description of the Related Art

Generally, an air conditioner includes a compressor, an outdoor heat exchanger, an expansion valve, and an indoor heat exchanger. The air conditioner may be used to maintain a temperature of an indoor space at a desired temperature to make the indoor space a more pleasant environment. That is, an air conditioner is a cooling/heating apparatus installed in a predetermined location or on a wall surface of an indoor place such as a vehicle, an office, or a home to cool down or heat the indoor place. The air conditioner uses a cooling cycle including a series of a compressor, an outdoor heat exchanger, an expansion valve (a capillary tube), an indoor heat exchanger or a heating cycle using reverse circulation of a coolant. However, since a related art air conditioner is fairly large in size and is installed and used on a wall surface of a building, it is difficult to move the air conditioner once it is installed. That is, it is nearly impossible to move the related air conditioner, which may cause an inconvenience in using the air conditioner. As a result, a mobile type air conditioner having moving wheels attached on a bottom of the air conditioner to allow a user to easily move the air conditioner is under development. Utility model No. 0252478 registered in Korea Intellectual Property Office (KIPO) discloses this related art mobile type air conditioner.

However, because direct coupling between inner parts and external cases is not properly performed according to the related art, the related art mobile air conditioner is not stable on the whole. Also, the external cases are generally coupled to each other using screws, but there is no structure for guiding the assembly between these external cases. Accordingly, since the respective parts are not fixed, coupling using screws is inconvenient.

SUMMARY OF THE INVENTION

Accordingly, the present invention is directed to an air conditioner that substantially obviates one or more problems due to limitations and disadvantages of the related art.

An advantage of the present invention is to provide an air conditioner having improved durability by allowing a rear frame, a base pan, and a main drain pan to be directly coupled to a front frame.

Another advantage of the present invention is to provide an air conditioner for improving an assembling efficiency by further providing a rib for guiding coupling between a front frame and a rear frame.

A further advantage of the present invention is to provide an air conditioner for allowing a front panel to be coupled at multiple locations to a rear frame using a provisional assembling element and a fixing element, and for more solidly fixing the front panel using an additional coupling element in the case where the front panel becomes heavy.

Another advantage of the present invention to provide an air conditioner having a detachable handle mounted on a lateral side of a rear frame without a separate coupling element, and forming the handle in a shape corresponding to that of a hand to ease use of the air conditioner.

An even further advantage of the present invention is to provide an air conditioner for allowing a suction grill to be detachable from a rear frame without a separate coupling member or a separate coupling process and having a plurality of filters for purifying air on one side of the suction grill.

Additional advantages and features of the invention will be set forth in the description which follows, and in part will be apparent from the description or may be learned from practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided an air conditioner including: a front frame providing a front portion; a rear frame providing a rear portion; a main drain pan for dividing a space between the rear frame and the front frame with an upper side and a lower side; and a base pan providing a bottom portion, wherein the front frame is coupled to the rear frame, the base pan, and the main drain pan.

In another aspect of the present invention, there is provided an air conditioner including: a front frame providing a front portion; a front panel provided to a front side of the front frame as part of the a front portion; and a discharge louver provided on one side of the front frame to control a discharge direction of air, wherein the front panel is coupled at multiple locations to the front frame.

In another aspect of the present invention, there is provided an air conditioner including: a front frame providing a front portion; a rear frame providing a rear portion; a suction grill installed in the rear frame and serving as an entry through which air is sucked; and an exhaust guide element mounted in the rear frame to guide exhaust of air to an outside, wherein a duct receiving groove for receiving a portion of the exhaust guide element is integrally formed in the suction grill.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
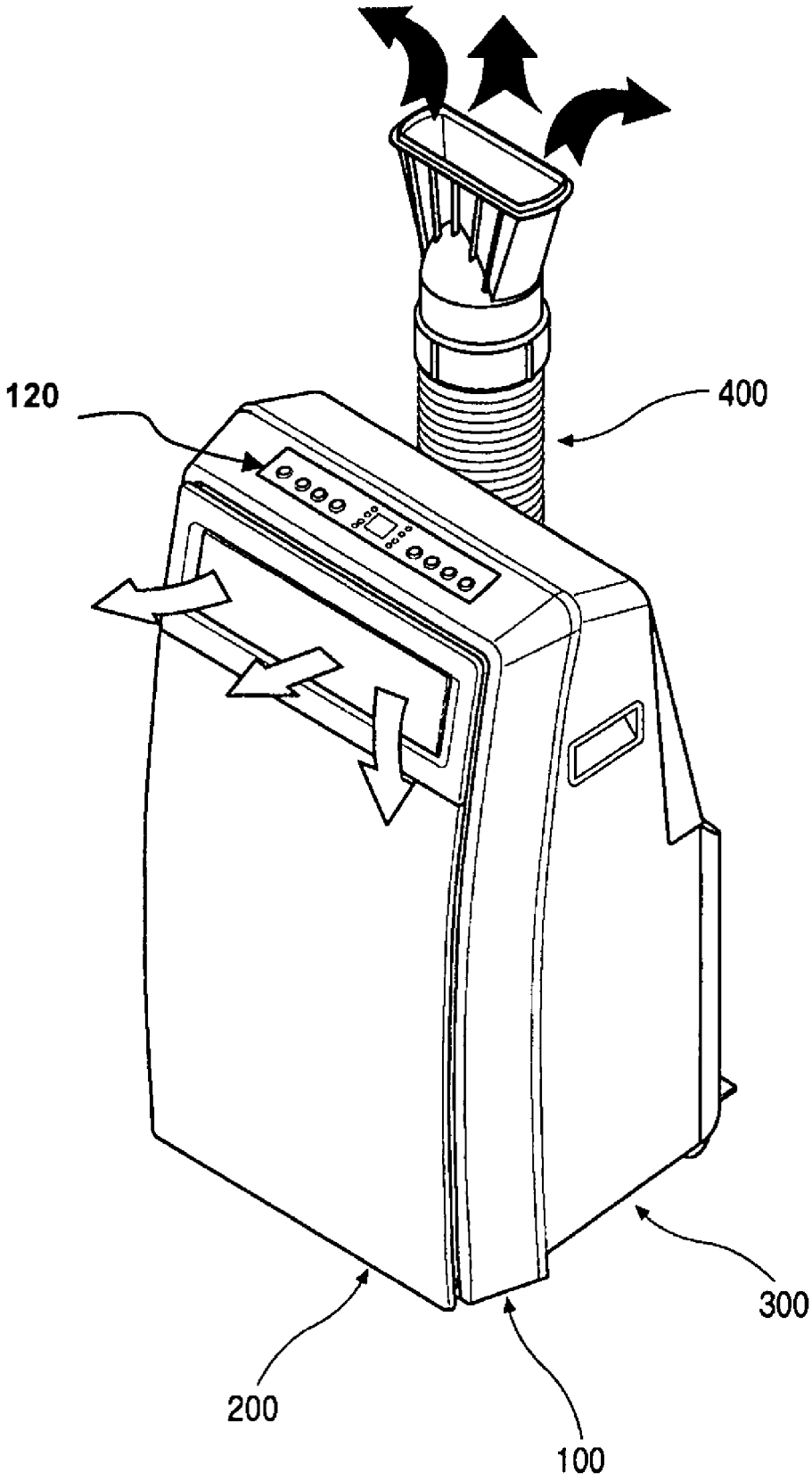
FIG. 1 is a front perspective view of an air conditioner according to an embodiment of the present invention.
Figure 2:
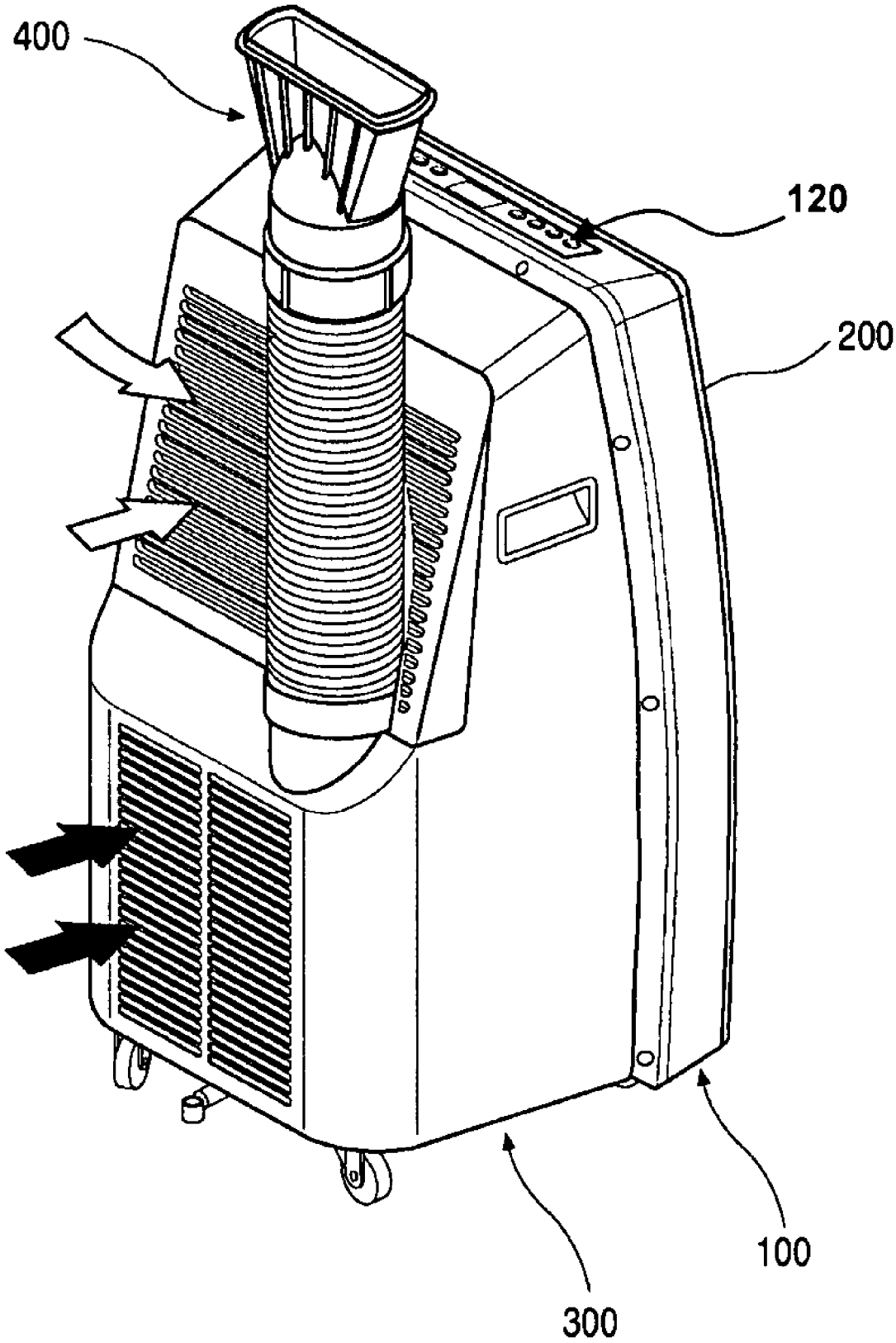
FIG. 2 is a rear perspective view of an air conditioner according to an embodiment of the present invention.

FIGS. 1 and 2 are perspective views illustrating a front view and a rear view of an air conditioner according to the present invention, respectively.

Referring to FIGS. 1 and 2, the air conditioner includes a front frame 100 and a front panel 200 forming a front portion, and a rear frame 300 forming a rear portion, by which an entire view of the air conditioner is schematically formed.

The front frame 100 provides a framework of a front part of the air conditioner, and simultaneously, provides portions of upper and right/left sides. A manipulation panel 120 for allowing a user to manipulate the air conditioner may be provided on the upper side.

The rear frame 300 is formed to provide the upper and right/left sides as well as a rear side of the air conditioner. An exhaust guide element 400 is connected to the rear frame 300 to exhaust heat-exchanged air to the outside (for example, an outdoor space). A construction of the exhaust guide element 400 will be described below in detail.

Figure 3:
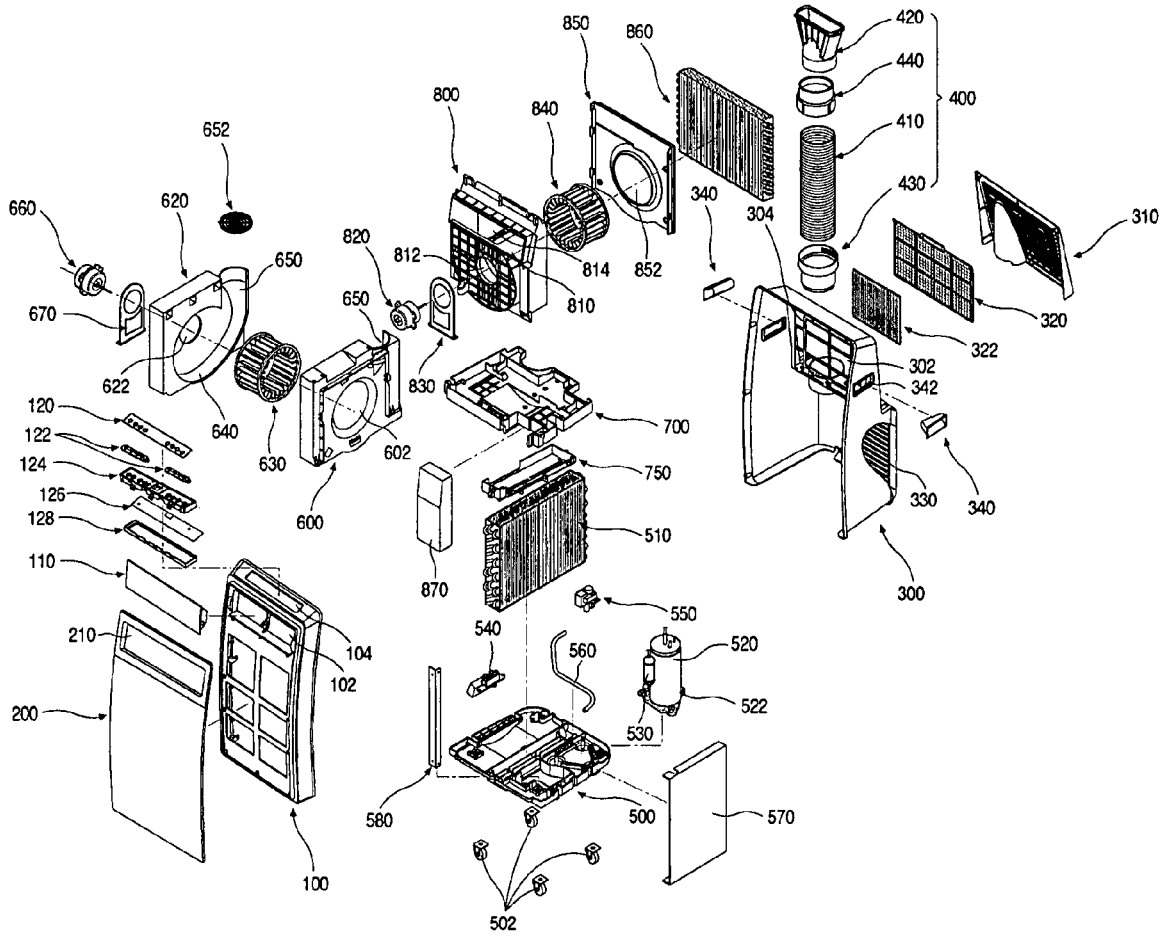
FIG. 3 is an exploded perspective view of an inner construction according to an embodiment of the present invention.

FIG. 3 is an exploded perspective view of an inner construction according to an embodiment of the present invention. Referring to FIG. 3, the front frame 100 is formed in, for example, a quadrangular shape. Also, the front frame 100 has a central portion formed to relatively protrude further to a front side. Therefore, the front frame 100 is formed to have a substantially rounded curvature on the whole when viewed from a side direction.

A louver installation opening 102 is formed in the vicinity of an upper end of the front frame 100. The louver installation opening 102 is a portion in which a discharge louver 110 may be installed. The louver installation opening 102 has a substantially quadrangular shape having the longer side formed in a horizontal direction.

An upper surface of the front frame 100 is formed to be inclined to the front at a predetermined angle (for example 5 degrees). A panel opening 104 in which a manipulation panel 120 is installed may be formed in the upper surface of the front frame 100 to pass through the front frame 100. The panel opening 104 has a substantially rectangular shape corresponding to a shape of the manipulation panel 120.

The front panel 200 is formed in a substantially quadrangular flat plate to constitute a front part of the air conditioner. The front panel 200 is fixedly installed on a front side of the front frame 100. Therefore, the front panel 200 has a shape corresponding to the front side of the front frame 100. That is, like the front frame 100, the front panel 200 has a central portion whose upper end relatively protrudes further to the front than a lower end, to form a substantially rounded shape (for example an arc shape).

A discharge louver 110 is installed in the louver installation opening 102 of the front frame 100 to guide air. The discharge louver 110 controls a discharge direction of air, and includes a plurality of discharge ribs to allow air to be discharged to a horizontal direction or a vertical direction. The manipulation panel 120 may be installed in the panel opening 104. The manipulation panel 120 is intended for a user's manipulation and includes a plurality of buttons installed to protrude to the outside. That is, a pair of button assemblies 122 may be provided under the manipulation panel 120, and the plurality of buttons provided to the button assemblies 122 may pass through the manipulation panel 120 and are exposed upward.

A manipulation printed circuit board (PCB) 124 is installed under the button assemblies 122. The manipulation PCB 124 converts button operations of the button assemblies 122 into signals that are sent to a controller (not shown). The manipulation PCB 124 is supported by a manipulation frame 126. Also, an outside of the manipulation PCB 124 is surrounded by a substantially rectangular box-shaped PCB case 128.

An air outlet 210 is formed in the vicinity of an upper end of the front panel 200 to pass through the front panel 200. The air outlet 210 is a portion through which air-conditioned (cooled or heated) air is discharged to the front, and has a substantially rectangular shape corresponding to the discharge louver 110. The rear frame 300 is coupled to the front frame 100. Therefore, a front end of the rear frame 300 may be molded in a shape corresponding to a shape of the front frame 100. That is, front ends of left and right sides of the rear frame 300 have a central portion protruding to the front to have a substantially rounded curvature such that the front ends of the left and right sides correspond to rear ends of left and right sides of the front frame 100.

An external air inlet 302 may be formed in an upper half portion of the rear frame 300 to pass through the rear frame 300. The external air inlet 302 is formed, for example, in a substantially quadrangular shape to serve as a passage through which air of an indoor space is sucked into the air conditioner.

A substantially quadrangular filter frame 304 corresponding to the external air inlet 302 is further formed at a central portion of the external air inlet 302. The filter frame 304 is, for example, preferably formed in a size smaller than that of the external air inlet 302 to support a special filter, for example, a deodorized.

The external air inlet 302 is shielded by a suction grill 310. Indoor air passes through the suction grill 310 and flows into the air conditioner. A plurality of holes are formed in the suction grill 310 to pass through the suction grill 310. The suction grill 310 is formed to have a size that substantially corresponds to that of the external air inlet 302. The suction grill 310 is formed to also be slightly inclined to the front.

A pre-filter 320 may be installed along an edge of the external air inlet 302. The pre-filter 320 is formed to have a size substantially corresponding to a size of the external air inlet 302 to filter foreign substances contained in the air that flows in through the suction grill 310.

A deodorized filter 322 may be further provided on a front side of the pre-filter 320. The deodorized filter 322 is formed in a size substantially corresponding to a size of the filter frame 304 and fixed in the filter frame 304 to remove an odor component contained in the air that flows in through the suction grill 310.

A lower grill 330 may be integrally formed in a lower half of the rear frame 300. The lower grill 330 allows air to be drawn into the air conditioner, and simultaneously, prevents inflow of foreign substances from the outside.

Handles 340 are further provided to either the rear frame 300 or the front frame 100. Handle holes 342 are formed in upper left and right sides of the rear frame 300 to pass through the rear frame 300, respectively. The handles 340 are inserted into the handle holes 342. The handles 340 permit a user to easily lift and move the air conditioner.

In an embodiment, the handles 340 are detachably and symmetrically installed in both sides of the rear frame 300. Therefore, a user can easily move the air conditioner by grabbing the handles 340 using both hands.

An exhaust guide element 400 is connected to the rear frame 300. The exhaust guide element 400 is intended for exhausting air that has been heat-exchanged in an inside of the air conditioner to an outdoor space. One end of the exhaust guide element 400 is connected to the rear frame 300, and the other end of the exhaust guide element 400 may be installed to be exposed to the outside of a building.

The exhaust guide element 400 is installed to communicate with an inside of the lower half of the rear frame 300, and includes an exhaust duct 410, an exhaust nozzle 420, a frame connector 430, and a nozzle connector 440.

The exhaust duct 410 is formed in a long cylinder-shaped tube to guide flowing of exhaust air, and the exhaust nozzle 420 is an end allowing exhaust air flowing through the exhaust duct 410 to be finally exhausted. The exhaust duct 410 may be formed of a flexible material such as plastic or shape so that it can be bent. Also, the frame connector 430 may be provided between the rear frame 300 and the exhaust duct 410 to allow a lower end of the exhaust duct 410 to be mounted in the rear frame 300. The nozzle connector 440 may be provided between the exhaust duct 410 and the exhaust nozzle 420 to allow the exhaust nozzle 420 to be coupled to an upper end of the exhaust duct 410.

A bottom portion of the air conditioner is formed by a base pan 500. The base pan 500 is coupled to lower ends of the front and rear frames 100 and 300, and supports a plurality of parts. The base pan 500 has a substantially quadrangular flat plate shape.

A plurality of moving wheels 502 are installed on a lower surface of the base pan 500. Each of the moving wheels 502 is intended for easily moving the air conditioner, and installed at each corner of the substantially quadrangle-shaped base pan 500.

A first heat exchanger 510 is installed on an upper central portion of the base pan 500. That is, the first heat exchanger 510 is installed, for example, on the upper central portion of the base pan 500 that ranges from a rear side to a front side. The first heat exchanger 510 cools down (or heats) coolant using a heat exchange between coolant flowing through the first heat exchanger 510 and air. That is, air that flows in through the lower grill 330 formed in the lower half of the rear frame 300 exchanges heat with coolant flowing through the first heat exchanger 510 while it passes through the first heat exchanger 510. The air that has been heat-exchanged while it passes through the first heat exchanger 510 is exhausted to an outdoor space through the exhaust guide element 400.

A compressor 520 may be installed to the right side of the first heat exchange 510. The compressor 520 is installed at a rear right end of the base pan 500, and supported by a substantially triangle-shaped compression frame 522. The compression frame 522 is mounted on the base pan 500.

An accumulator 530 is installed next to the compressor 520. The accumulator 530 filters liquid coolant to allow only gas coolant to flow into the compressor 520.

A condensed water detector 540 is installed in front of the compressor 520. When an amount of condensed water collected on an upper surface of the base pan 500 reaches a predetermined amount or more, the condensed water detector 540 detects the amount of condensed water and displays the detected condensed water to the outside.

A condensed water pump 550 is installed at a front right end of the base pan 500. The condensed water pump 550 pumps the condensed water collected on the base pan 500 to supply the condensed water to a sub-drain pan 750.

A condensed water pipe 560 is connected to the condensed water pump 550.

The condensed water pipe 560 serves as a passage for guiding condensed water forcibly flowed by the condensed water pump 550 to a sub-drain pan 750. Therefore, a lower end of the condensed water pipe 560 is connected to the condensed water pump 550, and an upper end of the condensed water pipe 560 is connected to the sub-drain pan 750.

A brace 570 is installed at a right end of the base pan 500. The brace 570 supports a right end of a main drain pan 700, which will be described later, and simultaneously, alleviates an impact generated when the compressor 520 falls down to the right. The brace 570 has a substantially quadrangle-shaped flat plate. The brace 570 has a lower end fixed to an upper right end of the base pan 500, and has an upper end fixed to a right end of the main drain pan 700.

Also, a support angle 580 can be installed at a front end of the base pan 500. That is, the support angle 580 is vertically installed at a front right end of the base pan 500 to support a front load of the main drain pan 700. A pair of support angles 580 may be installed at left and right of a front end of the main drain pan 700.

A lower orifice 600 is installed at a left side of the first heat exchanger 510. The lower orifice 600 supports a plurality of parts such as an upper orifice 850 and an upper air guide 800, and simultaneously, guides air that has passed through the first heat exchanger 510 to the left. For this purpose, a circular lower orifice hole 602 is formed in a central portion of the lower orifice 600 to pass through the lower orifice 600. A lower air guide 620 is installed on the left side of the lower orifice 600. The lower air guide 620 guides air flowing in cooperation with the lower orifice 600. A lower fan 630 for forcing air flowing is located between the lower orifice 600 and the lower air guide 620. For this purpose, housing grooves 640 are symmetrically formed in the lower orifice 600 and the lower air guide 620 to guide air flowed by a lower fan 630.

That is, the housing grooves 640 symmetric with each other are formed in a left side of the lower orifice 600 and a right side of the lower air guide 620 to guide air discharged by the lower fan 630. The housing grooves 640 are formed to have a greater diameter than an outer diameter of the lower fan 630 to surround the lower fan 630.

Exhaust guides 650 having shapes symmetric with respect to each other are formed at rear ends of the lower orifice 600 and the lower air guide 620. The exhaust guides 650 guide air guided by the housing grooves 640 to the exhaust guide element 400. Upper ends of the exhaust guides 650 constitute a shape corresponding to that of a lower end of the exhaust guide element 400.

A circular exhaust grill 652 is inserted and mounted in an upper inner end of the exhaust guides 650. The exhaust grill 652 prevents external foreign substances from being inserted to a lower portion of the exhaust guides 650.

A lower motor hole 622 is formed in a central portion of the lower air guide 620 to pass through the lower air guide 620. Therefore, a lower motor 660 is inserted to pass through the lower motor hole 622 so that it is fixedly installed therein. The lower motor 660 generates rotational power using power supplied from the outside and provides the rotational power to the lower fan 630 to rotate the lower fan 630.

A lower motor support 670 is further provided to the right side of the lower air guide 620. The lower motor support 670 is intended for more solidly supporting the lower motor 660 mounted in the lower air guide 620. A lower end of the lower motor support contacts the base pan 500. The main drain pan 700 is installed on a central rear side of the front frame 100. The main drain pan 700 has a substantially quadrangular shape as illustrated. The main drain pan 700 collects condensed water generated at a second heat exchanger 860 which will be described later, and simultaneously, supports a plurality of parts, and vertically divides an inner space of the air conditioner.

In more detail, an integral type is generally divided into an indoor side and an outdoor side. The main drain pan 700 divides the inside of the air conditioner into an indoor side and an outdoor side. That is, the outdoor side (a heat sink side) corresponding to an outdoor unit (in a separation type air conditioner) is formed below the main drain pan 700, and the indoor side (a heat absorbing side) corresponding to an indoor unit (in a separation type air conditioner) is formed above the main drain pan 700.

A sub-drain pan 750 is installed under the main drain pan 700. The sub-drain pan 750 collects and dispenses condensed water supplied by the main drain pan 700 and the condensed water pump 550.

In detail, the sub-drain pan 750 extends laterally, and is installed on an upper side of the first heat exchanger. Therefore, condensed water collected on the main drain pan 700 falls down to the sub-drain pan 750 and is collected. Also, condensed water collected on the base pan 500 is supplied to the sub-drain pan 750 via the condensed water pipe 560. The condensed water supplied to the sub-drain pan 750 is uniformly sprayed on an upper end of the first heat exchanger 510 and evaporated.

An upper air guide 800 is installed on an upper side of the main drain pan 700. The upper air guide 800 is installed to across left and right of an upper side of the main drain pan 700 to guide air flowed by an upper fan 840. An upper fan housing 810 is integrally formed with the upper air housing 800. The upper fan housing 810 is installed to surround an outer side of the upper fan 840. Therefore, air forcibly discharged by the upper fan 840 is guided by the upper fan housing 810 to flow to a discharge guide opening 814. An upper motor hole 812 is formed in a central portion of the upper air guide 800 to pass through the upper air guide 800. An upper motor 820 is inserted into the upper motor hole 812 to provide rotational power to the upper fan 840.

The discharge guide opening 814 is formed in an upper end of the upper air guide 800 to pass through the upper air guide 800 and overlap with the air outlet guide. The discharge guide opening 814 has a rectangular shape corresponding to a shape of the discharge louver 110. Therefore, air guided by the upper fan housing 810 flows to the front via the discharge guide opening 814 to pass through the discharge louver 110.

An upper motor support 830 is further provided on a lower side of the upper motor 820. The upper motor support 830 performs the same function as that of the lower motor support 670. That is, the upper motor support 830 provides a more solid support for the upper motor 820. For this purpose, a lower end of the upper motor support 830 is fixedly mounted on a front upper surface of the main drain pan 700.

The upper fan 840 is received inside the upper fan housing 810. The upper fan 840 forces external air to flow via the suction grill 310. The upper fan 840 is coupled at a rear end of the upper motor 820 to rotate.

An upper orifice 850 may be provided on a rear side of the upper air guide 800. The upper orifice 850 may be formed in a substantially quadrangular flat plate. A circular upper orifice hole 852 is formed in a central portion of the upper orifice 850 to pass through the upper orifice 850 so that air can flow through the upper orifice hole 852.

The second heat exchanger 860 is installed horizontally long in a rear portion behind the main drain pan 700 to allow air sucked via the suction grill 310 to exchange heat with coolant flowing through the second heat exchanger 860.

Meanwhile, a control box 870 is installed at a front right end of the main drain pan 700. The control box 870 mounts a plurality of electric components controlling an operation of the air conditioner therein. The control box 870 is installed to pass through the main drain pan 700. That is, an upper half of the control box 870 protrudes above the main drain pan 700, and a lower half of the control box 870 protrudes below the main drain pan 700.

Figure 4:
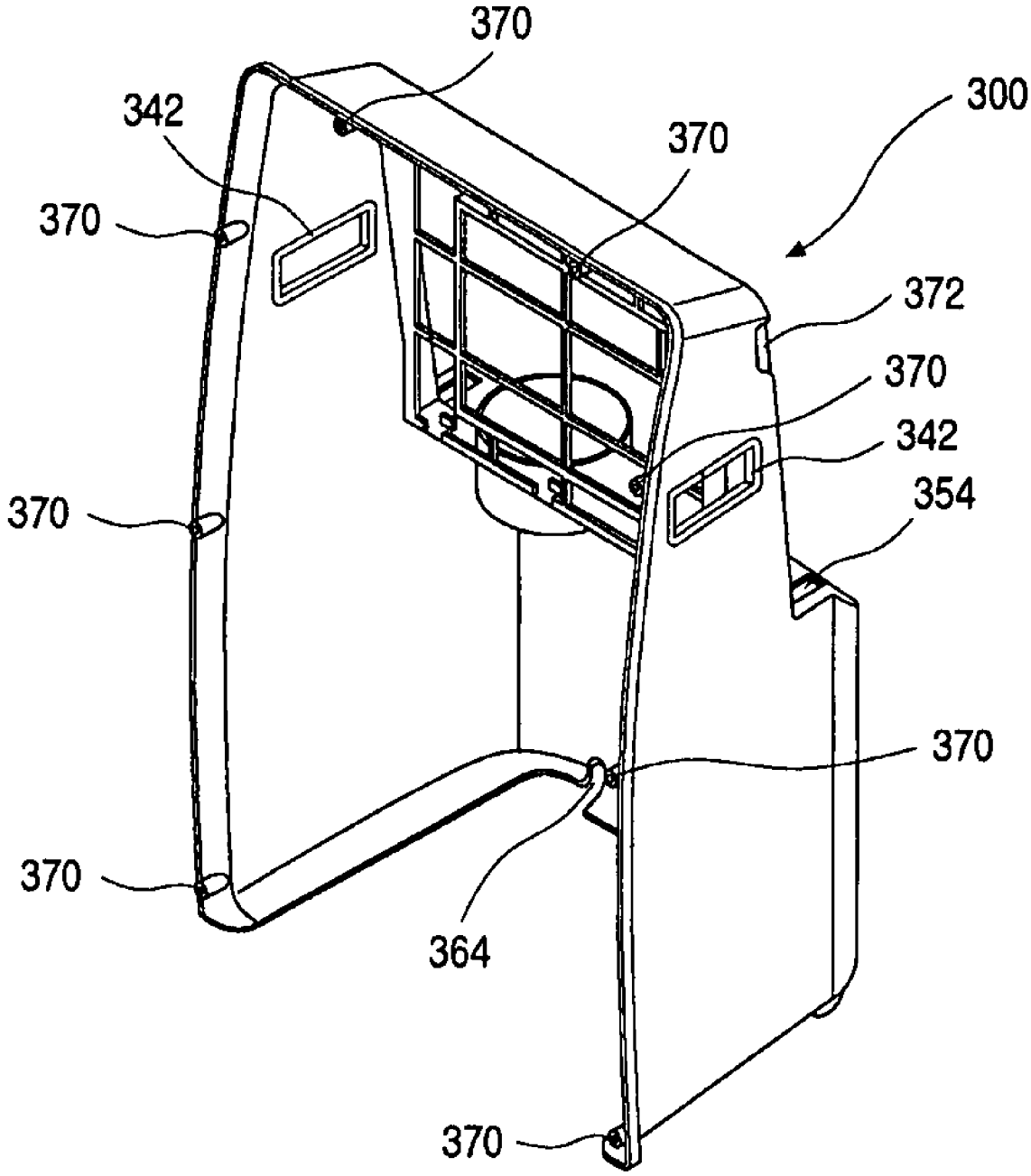
FIGS. 4 and 5 are front and rear perspective views illustrating a detailed construction of a rear frame according to an embodiment of the present invention.
Figure 5:
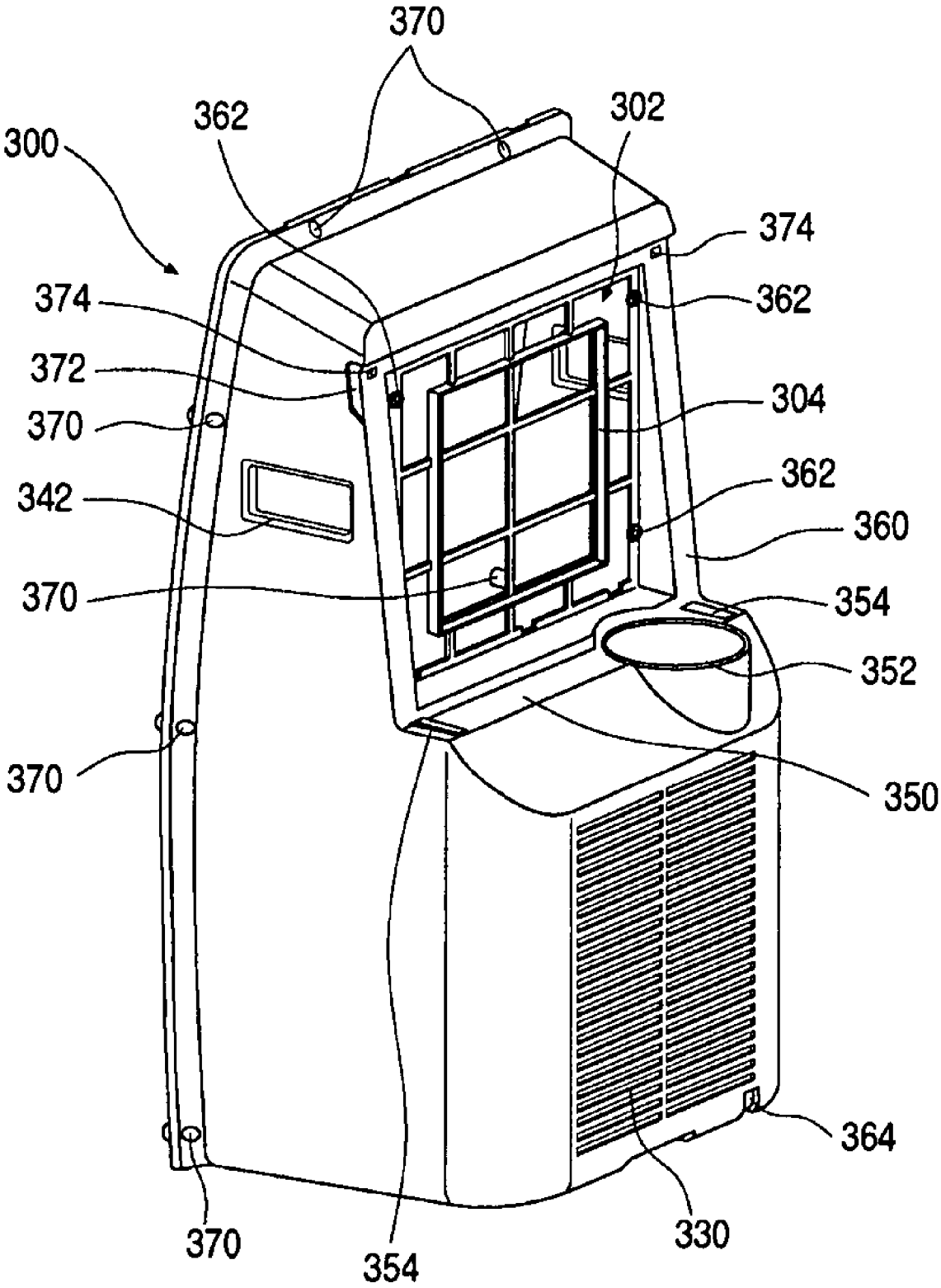

FIGS. 4 and 5 are a front perspective view and a rear perspective view of the rear frame 300. A construction of the rear frame 300 will be described in more detail with reference to FIGS. 4 and 5.

A rear side of the rear frame 300 is formed to have a height difference. In detail, the length of an upper half is different from the length of the lower half of the rear frame 300. That is, the length of the upper half of the rear frame 300 is greater than that of the lower half of the rear frame 300. Therefore, a height difference surface 350 is formed at a central portion of the rear frame 300. That is, the height difference surface 350 formed horizontally may be provided below the external air inlet 302 formed in the upper half of the rear frame 300 to pass through the rear frame 300.

Also, a duct connecting hole 352 is formed in the height difference surface 350 to vertically pass through the height difference surface 350. The duct connecting hole 352 is a portion to which a lower end of the exhaust guide element 400 is coupled. That is, the frame connector 430 constituting the exhaust guide element 400 is inserted into the duct connecting hole 325. Therefore, the duct connecting hole 352 is formed in a cylindrical shape having a size and a shape corresponding to a lower end of the frame connector 430.

A grill projection receiving hole 354 is formed in left and right ends of the height difference surface 350 to vertically pass through the height difference surface 350.

The grill projection receiving hole 354 receives a grill coupling projection 317 of the suction grill 310.

Meanwhile, a grill mounting part 360 is formed on an upper side of the height difference surface 350. The grill mounting part 360 is a portion on which the suction grill 310 is mounted, and is formed on a rear side of the external air inlet 302.

Also, a plurality of filter fixing hooks 362 are formed along edges of the external air inlet 302 to mount the pre-filter 320 thereon. That is, the filter fixing hooks 362 having a hook shape and protruding to a rear side are formed at four corners along rear edges of the external air inlet 302, respectively, to fix four corners of the pre-filter 320.

Also, the lower grill 330 is formed below the height difference surface 350. The lower grill 330 may be formed only in a right portion of the lower half of the rear frame 300. That is, though the lower grill 310 is formed over an entire portion of the lower half of the rear frame 300 in FIG. 5, the lower grill 300 is formed for compatibility in this case. Actually, air can flow through only a right portion, and cannot flow through a left portion because an inner side of the left portion is shielded.

The reason the lower grill 330 is formed in only the right portion of the rear frame 300 is to allow air sucked through the lower grill 330 to pass through the first heat exchanger 510. That is, the lower grill 330 is formed in only the right portion of the rear frame 300 to allow the air sucked from a rear side through the lower grill 330 to flow to the right of the first heat exchanger 510, pass through the first heat exchanger 510, and move to the left of the first heat exchanger 510.

A piping hole 364 is formed in a lower end of the rear frame 300. The piping hole 364 is a portion in which a draining pipe (not shown) is formed. The draining pipe allows condensed water to be drained.

A plurality of frame coupling projections 370 for coupling to the front frame 100 are formed along a front end of the rear frame 300. The frame coupling projections 370 are portions into which coupling members such as screws are inserted. The frame coupling projections 370 are formed at central portions of left and right front ends, an upper end, and a lower end of the rear frame 300, and left and right of an upper front side of the rear frame 300. Therefore, when screws are inserted into the frame coupling projections 370 and coupled to the front frame 100, coupling of the front and rear frames 100 and 300 is performed.

Meanwhile, a detachment groove 372 is formed in a rear end of a lateral upper end of the rear frame 300. The detachment groove 372 is formed to be recessed a predetermined distance from both sides of the rear frame 300 to an inner side. The detachment groove 372 has a vertical length corresponding to a human hand.

The detachment groove 372 is intended for preventing interference with a user's hands when the user grabs a detachment rib 315 (FIG. 6) in order to pull the detachment rib 315 of the suction grill 310 to the front.

Grill hook coupling holes 374 are formed in a rear upper end of the rear frame 300 to pass through the rear frame 300. The grill hook coupling holes 374 are portions into which grill coupling hooks 316 are inserted and coupled. The grill hook coupling holes 374 are formed to have a size corresponding to that of a front end of the grill coupling hook 316.

In more detail, the grill hook coupling holes 374 extending through the grill mounting part are formed in upper left and right ends of the grill mounting part 360. The grill hook coupling holes 374 have a size through which a hooking part 316' (FIG. 6) of the grill coupling hook 316 can pass.

Figure 6:
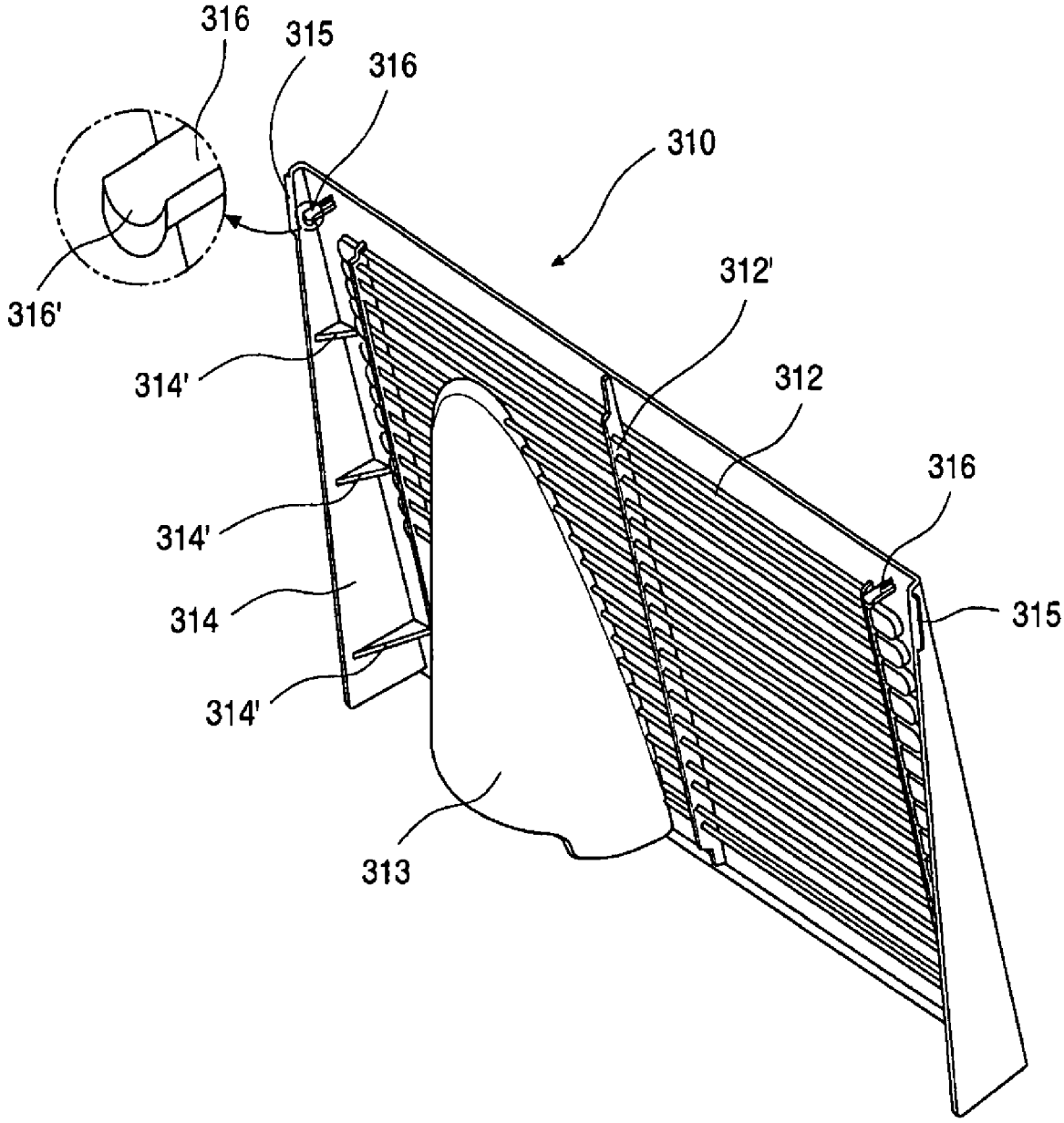
FIGS. 6 and 7 are front and rear perspective views illustrating a detailed construction of a suction grill according to an embodiment of the present invention.
Figure 7:
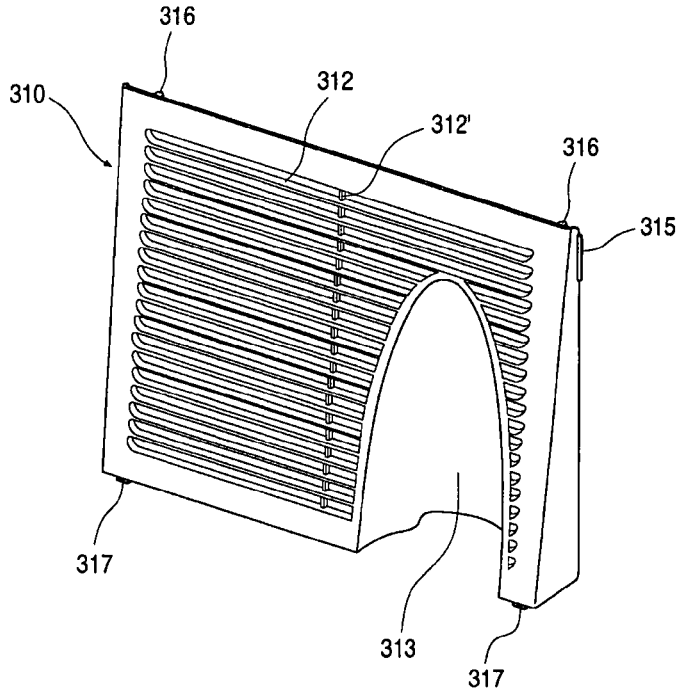

FIGS. 6 and 7 are front and rear perspective views of the suction grill 310, respectively. Referring to FIGS. 6 and 7, a plurality of grill ribs 312 are formed with an equal interval on the suction grill 310. Therefore, air is sucked through gaps between the plurality of grill ribs 312.

Also, the gaps between the plurality of grill ribs 312 may be shielded using a mesh network or a gauze. This prevents external foreign substances from passing through the grill ribs 312.

A rib support 312' is vertically formed at a central portion of the suction grill 310. The rib support 312' supports the plurality of grill ribs 312. A duct receiving groove 313 is formed in the suction grill 310 to receive a portion of the exhaust guide element 400. That is, the duct receiving groove 313 collapsing to the front (in FIG. 6) is formed in a left portion of the suction grill 310. A lower end of the duct receiving groove 313 has a semicircular groove shape corresponding to a front side of the exhaust duct 410. Therefore, front ends of the exhaust duct 410 and the frame connector 430 are received in the duct receiving groove 313.

The suction grill 310 is formed to have a predetermined slope toward the front. Therefore, both ends of the suction grill 310 are bent to the front and extended to form grill lateral sides 314 of a substantially triangular shape whose width increases toward a lower end. Also, a plurality of grill reinforcing ribs 314' are formed on an inner surface of the grill lateral sides 314 to reinforce support strength.

The detachment ribs 315 are formed at upper ends of the suction grill 310 to allow a user to detach the suction grill 310. In more detail, the detachment ribs 315 protruding with a predetermined size in a lateral direction are formed at upper ends of the grill lateral sides 314. Therefore, when a user grabs the detachment ribs 315 and pulls the detachment ribs 315 in a rear direction, an upper end of the suction grill 310 is separated from the rear frame 300.

A pair of grill coupling hooks 316 is formed at upper ends of the suction grill 310. The grill coupling hooks 316 protrude to the front from left and right upper ends of the suction grill 310 to allow the upper end of the suction grill 310 to be coupled to the rear frame 300.

The grill coupling hooks 316 are formed to have elasticity of its own such that their front ends moves and restores a predetermined distance vertically and horizontally. The hooking parts 316' having a relatively greater cross-section than that of a rear portion is formed at the front ends.

Therefore, after the grill coupling hooks 316 are inserted into the grill hook coupling holes 374 of the rear frame 300, the grill coupling hooks 316 are not detached from the grill hook coupling holes 374 because of the hooking part 316' of the grill coupling hook 316 unless force of predetermined intensity is applied.

The grill coupling projections 317 are formed at lower ends of the suction grill 310. The grill coupling projections 317 are portions inserted into the grill projection receiving holes 354. Therefore, the grill coupling projections 317 are formed to protrude in a predetermined size from left and right lower ends of the suction grill 310 to a lower direction, and have a horizontal size corresponding to a width of the grill projection receiving holes 354.

Figure 8:
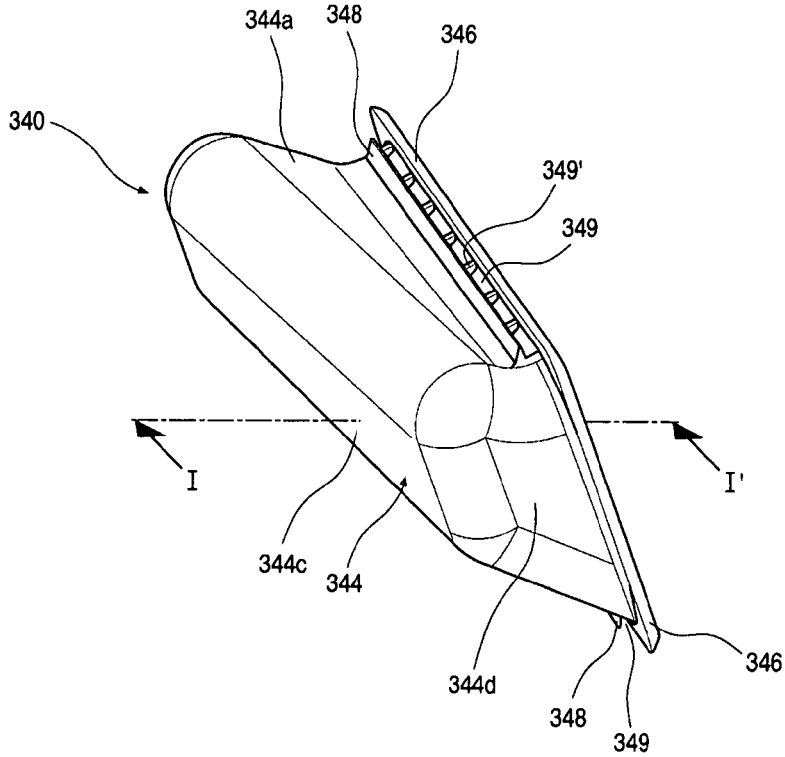
FIGS. 8 and 9 are perspective views illustrating constructions of a right handle and a left handle according to an embodiment of the present invention.
Figure 9:
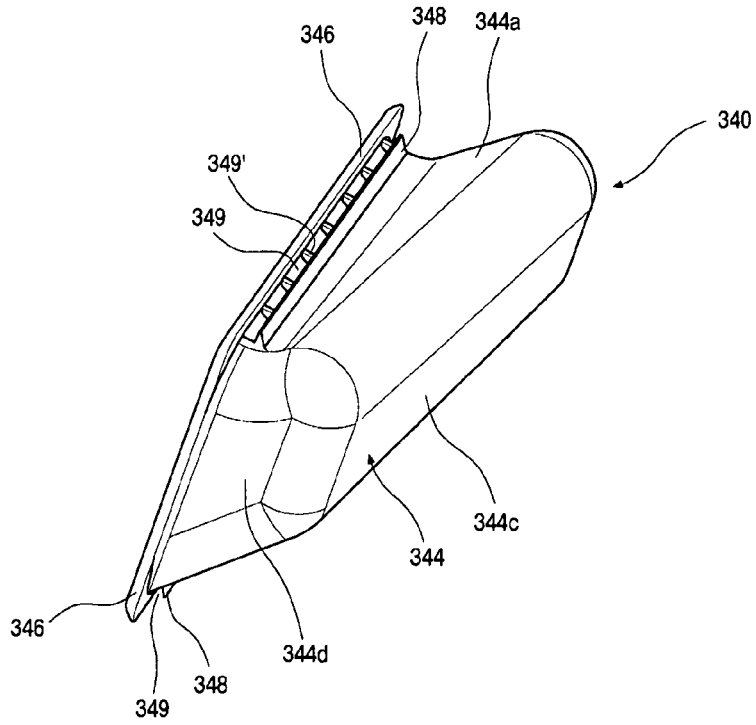
Figure 10:
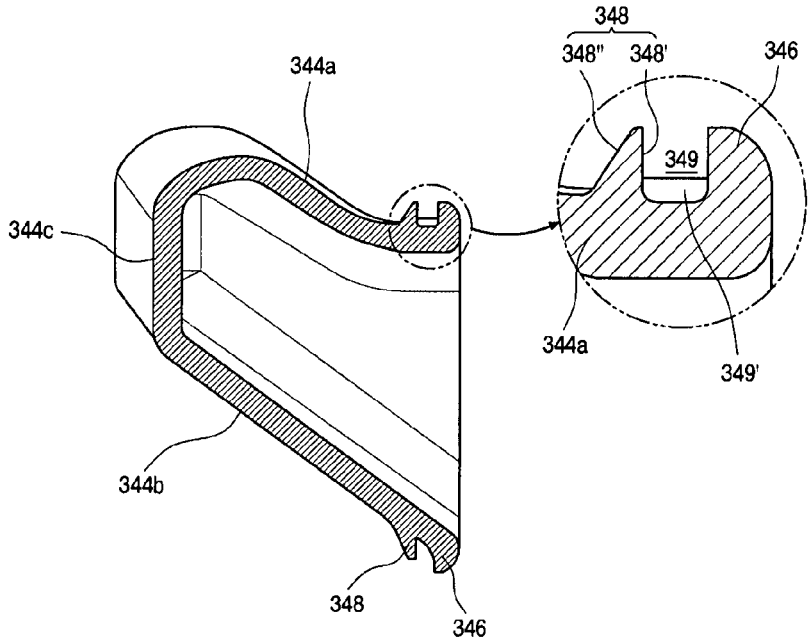
FIG. 10 is a cross-sectional view taken along a line I-I' of FIG. 8.
Figure 11:
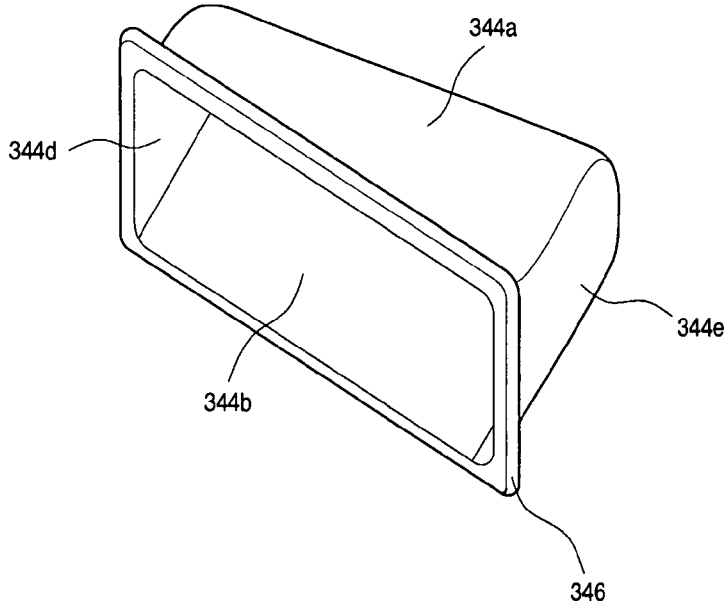
FIG. 11 is a perspective view illustrating a right side construction of the handle illustrated in FIG. 8.

FIGS. 8 to 11 illustrate, in more detail, a construction of the handle 340. That is, FIG. 8 is a perspective view of a handle of a pair of handles 340 that may be installed on a right side of the rear frame 300, and FIG. 9 is a perspective view of a handle that may be installed on a left side of the rear frame 300. Also, FIG. 10 is a cross-sectional view taken along a line I-I' of FIG. 8, and FIG. 11 is a perspective view illustrating a right side of the handle illustrated in FIG. 8.

A construction of the handle 340 will be described below with reference to the accompanying drawings. Also, since the handles 340 on both sides (FIGS. 8 and 9) have shapes symmetric with respect to each other, descriptions will be made with reference to FIGS. 8, 10, and 11 illustrating the handle on the right side.

As illustrated, the handle 340 includes a handle body 344 for receiving a user's fingers, a handle edge 346 protruding along an edge of the handle body 344, and a fixing rib 348 formed on a location spaced a predetermined distance from the handle edge 346.

The handle body 344 is a portion into which a user's fingers are inserted, and is formed in an about 'ㄷ'shape so that a predetermined space is formed inside the handle body 344. Therefore, four fingers except a thumb may be inserted into this inner space.

The handle body 344 includes a handle upper surface 344*a* constituting an upper portion, a handle lower surface 344*b* formed at a location separated a predetermined distance from the handle upper surface 344*a* to constitute a bottom part, a handle lateral surface 344*c* connecting the handle upper surface 344*a* with the handle lower surface 344*b* and simultaneously constituting a lateral part, and a handle front surface 344*d* and a handle rear surface 344*e* constituting a front portion and a rear portion, respectively.

The handle edge 346 protrudes in a predetermined size to an outer side and in a horizontal direction along an edge of a right end of the handle body 344 having an about rectangular shape. Therefore, the handle edge 346 contacts an outer surface of the rear frame 300 when the handle 340 is mounted in the handle hole 342 of the rear frame 300.

The fixing rib 348 is formed long and projects from an upper surface and a lower surface of the handle 340. The fixing rib 348 is formed in a location separated a predetermined distance from the handle edge 346. Therefore, the fixing rib 348 is located inside the rear frame when the handle 340 is mounted in the handle hole 342.

In more detail, referring to FIG. 10, the fixing rib 348 has a substantially triangle-shaped cross-section (when seen from a front side). In other words, a right surface and a left surface of the fixing rib 348 include a vertical surface 348' and a guide surface 348". The vertical surface 348' contacts an inner surface of the rear frame 300, and the guide surface 348" guides mounting of the handle 340. That is, the guide surface 348" is formed to have an acute angle with the vertical surface 348' to allow the handle 340 to slide on an edge of the handle hole 342 and pass through the handle hole 342 when the handle 340 is inserted into the handle hole 342 from a side direction. A handle groove 349 is formed between the handle edge 346 and the fixing rib 348 spaced from each other. Therefore, a lateral side of the rear frame 300 is inserted into this handle groove 349.

The handle groove 349 is formed in an U-shape (when viewed from a front side). A plurality of handle reinforcing ribs 349' are arranged with a predetermined interval on a lower surface of the handle groove 349 to more solidly support the fixing rib 348.

Meanwhile, the handle body 344 is formed such that its horizontal width gradually decreases toward the front side.

When the handle body 344 is formed such that its horizontal width gradually decreases toward the front side, a user can easily grab the handle 340. That is, such a shape of the handle 340 is formed with consideration of a difference in respective human fingers.

For example, in the case where the air conditioner of the present invention is raised by a user from the front direction, an index finger (a second finger) of the user is received in an inner rear end of the handle body 344, and a little finger is positioned at an inner front end of the handle body 344. Therefore, for swift receiving the index finger, a width of a rear end of the handle body 344 is made wider than that of a front end of the handle body 344.

Also, the handle body 344 has a shape that is gradually inclined upward as it is distant from the handle edge 346. That is, in FIG. 10, a left end of the handle body 344 is located in a higher position than that of a right end of the handle body 344. Such a shape is for preventing a user's hand from being easily detached from the inside of the handle body 344 once inserted into the handle body 344. In more detail, the pair of left and right handle bodies 344 has a shape that is inclined upward as it reaches a central portion of the air conditioner. Therefore, referring to FIG. 10, each of the handle upper surface 344*a* and the handle lower surface 344*b* is an inclined surface. That is, each of the handle upper surface 344*a* and the handle lower surface 344*b* becomes higher in position as it goes to the left side.

Figure 12:
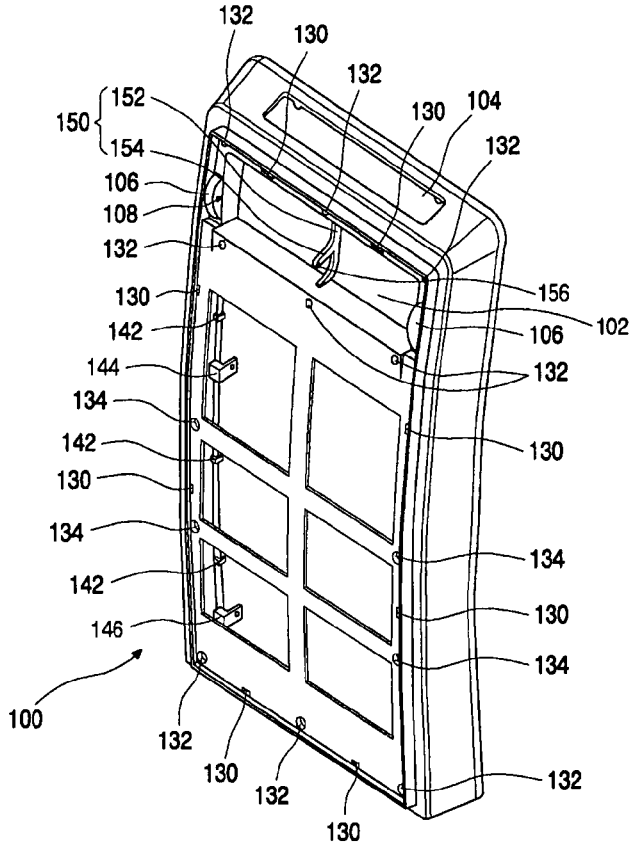
FIGS. 12 and 13 are front and rear perspective views of a front frame according to an embodiment of the present invention.
Figure 13:
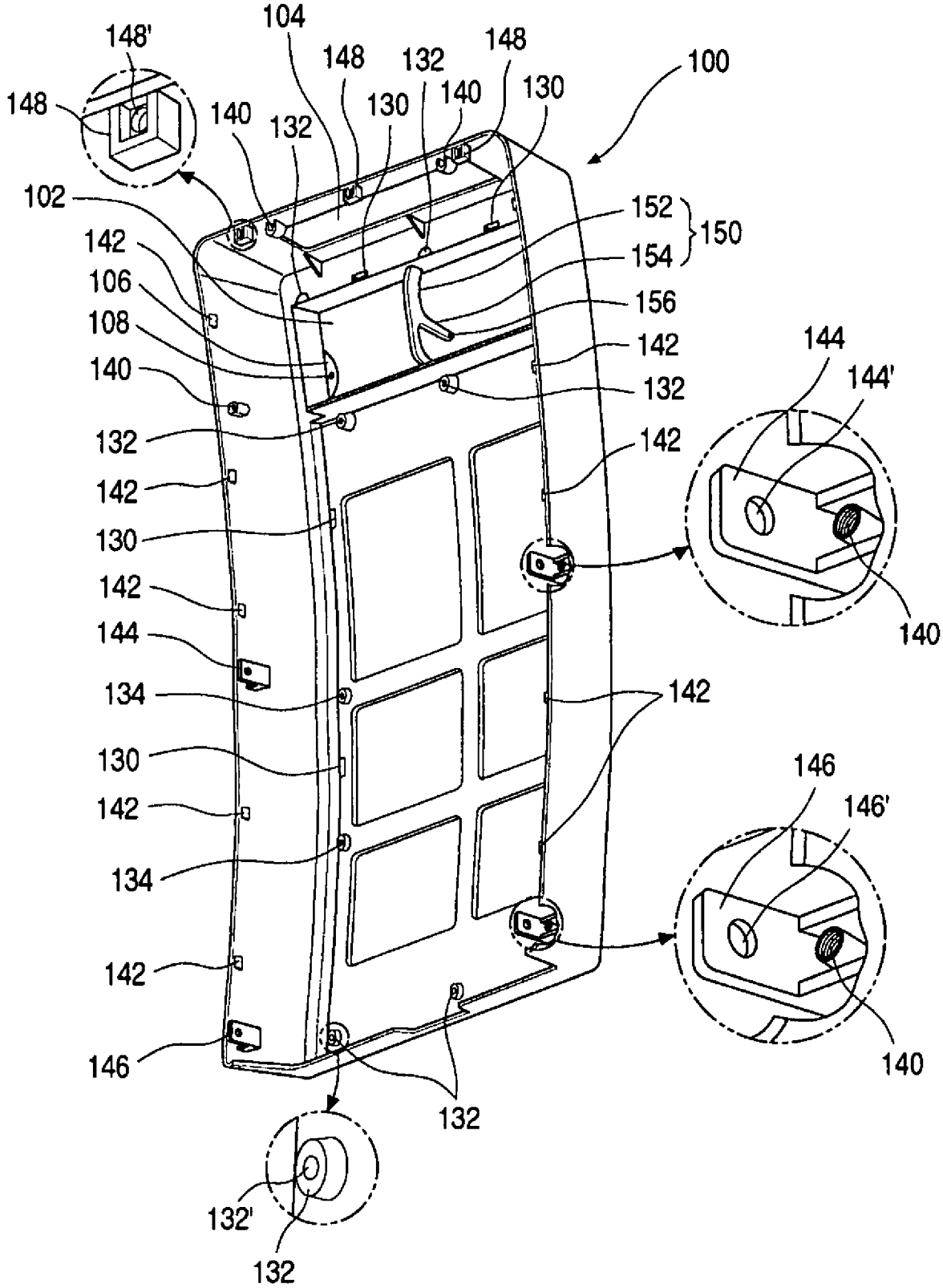

FIGS. 12 and 13 are a front perspective view and a rear perspective view of the front frame 100, respectively.

Referring to FIGS. 12 and 13, the front frame 100 is formed in a grating shape and includes a plurality of substantially quadrangular openings. Also, though not shown, a reinforcing panel can be installed on a rear side of the front frame 100 in which the plurality of openings are formed. The reinforcing panel performs a soundproofing function and a sound-absorbing function for absorbing or blocking noises generated from an inside of the air conditioner, and is preferably formed of a material (for example a sponge) that can absorb water (e.g., condensed water) created from an inside of the air conditioner.

The front panel 200 is doubly fixedly installed on the front frame 100. That is, the front panel 200 is doubly fixed and mounted on the front frame 100 using a provisional assembling element and a fixing element.

The provisional assembling element allows the front panel 200 to be provisionally assembled to the front frame 100, and includes a plurality of panel hooks 220 and panel hook holes 130 which will be described below in detail Also, the fixing element allows the front panel 200 to be fixed on the front frame 100 using a coupling element, and includes panel coupling parts 132, a panel coupling projection 222, and a coupling member (e.g., screws).

In more detail, the plurality of panel hook holes 130 are formed in the front frame 100. The panel hook holes 130 are portions to which the plurality of panel hooks 220 of the front panel 200 are inserted and coupled. The plurality of panel hook holes 130 are formed along a front edge of the front frame 100.

Meanwhile, the panel coupling parts 132 are formed in the front frame 100. The panel coupling parts 132 are formed on an upper side and a lower end of the front frame 100. That is, three panel coupling parts 132 are formed on an upper end of the louver installation opening 102, and three panel coupling parts 132 are formed on a lower end of the louver installation opening 102 with a predetermined interval. Also, three panel coupling parts 132 are formed horizontally with a predetermined interval on a lower end of the front frame 100. The panel coupling parts 132 are portions through which coupling members (not shown) such as screws pass. Therefore, panel coupling holes 132' are formed in central portions of the panel coupling parts 132 to allow the coupling members to be inserted into and pass through the panel coupling holes 132'.

Also, additional coupling parts 134 are further formed on the front frame 100. The additional coupling parts 134 are formed in the same shapes as those of the panel coupling parts 132, but forming positions of the additional coupling parts 134 are different. That is, the additional coupling parts 134 are preferably formed at central portions of the front frame 100. In more detail, two additional coupling parts 134 are formed at the left and right of a lower half of the front frame 100.

The additional coupling parts 134 serve as additional coupling means together with additional coupling projections 224 of the front panel 200. The additional coupling means is selectively used depending on a weight of the front panel 200. That is, the additional coupling means is used to allow the front panel 200 to be more solidly fixed on the front frame 100 in the case where a heavy part such as a glass is further installed on a front side of the front panel 200.

Therefore, a coupling member such as the panel coupling parts 132 passes through the additional coupling parts 134.

A plurality of frame coupling parts 140 are formed on lateral sides and an upper rear end of the front frame 100. The frame coupling parts 140 are portions to which coupling members (not shown) such as screws are coupled, and are formed at positions corresponding to the frame coupling projections 370 of the rear frame 300. Therefore, when the coupling members pass through the frame coupling projections 370 and couple to the frame coupling parts 140, the rear frame 300 and the front frame 100 are coupled to each other. Screw grooves to which coupling members such as screws are coupled are formed in central portions of the plurality of frame coupling parts 140.

A plurality of coupling guide ribs 142 protrude inward from a lateral rear end of the front frame 100. The coupling guide rib 142 is intended for guiding assembling of the front frame 100 and the rear frame 300, and is formed in a '[' or ']' shape (when seen from an upper side). Therefore, an edge of the rear frame 300 is inserted into a gap between the coupling guide rib 142 and the front frame 100.

A pair of drain coupling members 144 protrude inward from a lateral side of the front frame 100. The drain coupling members 144 protrude inward from both lateral sides of the front frame 100 to be symmetric with each other, and are formed in a '[' or ']' shape (when seen from an upper side).

The drain coupling members 144 allow the front frame 100 to be coupled to the main drain pan 700 using a coupling member. Therefore, a drain coupling hole 144' is formed in a rear end of the drain coupling member 144 to pass through the drain coupling member 144 so that a coupling member such as a screw passes through the drain coupling hole 144'.

Also, referring to FIG. 13, the frame coupling parts 140 are integrally formed with an inside of the drain coupling members 144.

A pair of base coupling members 146 protrude inward from a lateral lower end of the front frame 100. The base coupling members 146 protrude inward from both sides of the front frame 100 to be symmetric with respect to each other, and are formed in a '[' or ']' shape (when seen from an upper side) as in the drain coupling members 144.

The base coupling members 146 are intended for allowing the front frame 100 and the base pan 500 to be coupled to each other using a coupling member such as a screw. Therefore, a base coupling hole 146' is formed in a rear end of the base coupling member 146 to pass through the base coupling member 146 so that a coupling member such as a screw passes through the base coupling hole 146'.

Also, the frame coupling part 140 is integrally formed with an inside of the base coupling member 146 as in the inside of the drain coupling member 144.

A plurality of air guide coupling members 148 are formed at an upper rear end of the front frame 100. The air guide coupling members 148 are intended for the upper air guide 800 to be coupled to the front frame 100. Three air guide coupling members 148 are formed with a predetermined interval at a lower side of an upper rear end of the front frame 100. An air guide coupling hole 148' is formed in the air guide coupling members 148 to pass through the air guide coupling members 148 so that a coupling member such as a screw passes through the air guide coupling hole 148'.

Louver installation parts 106 are formed on both sides of the louver installation opening 102, respectively. The louver installation parts 106 are portions at which both ends of the discharge louver 110 is installed and supported, and are formed in a substantially semicircle shape protruding to the front in a substantially rounded shape.

Also, a louver installation groove 108 is recessed in a lateral direction from an inner lateral side of the louver installation part 106. A louver rotational shaft 111 of the discharge louver 110 is inserted into the louver installation groove 108. The louver installation groove 108 is formed in each of lateral sides of the pair of the louver installation parts 106. A front side of at least one of the two louver installation grooves 108 is preferably open to allow the louver rotational shaft 111 to be easily installed.

A louver motor (not shown) providing rotational power to the discharge louver 110 is installed inside at least one of the pair of the louver installation parts 106 formed at both ends of the louver installation opening 102.

A louver support 150 is integrally formed at a central portion of the louver installation opening 102. The louver support 150 is vertically formed to support a central portion of the discharge louver 110.

The louver support 150 includes a connection part 152 installed vertically across the louver installation opening 102, and a stopper 154 extending to the front from a central portion of the connection part 152. Also, an upper end and a lower end of the stopper 154 contact a groove front side 114' and a groove lower side 114" of the discharge louver 110 to limit a rotation range of the discharge louver 110.

A louver support hole 156 is formed in a front end of the stopper 154 to pass through the stopper 154. The louver support hole 156 is a portion into and by which a central support shaft 115 of the discharge louver 110 is inserted and supported.

Figure 14:
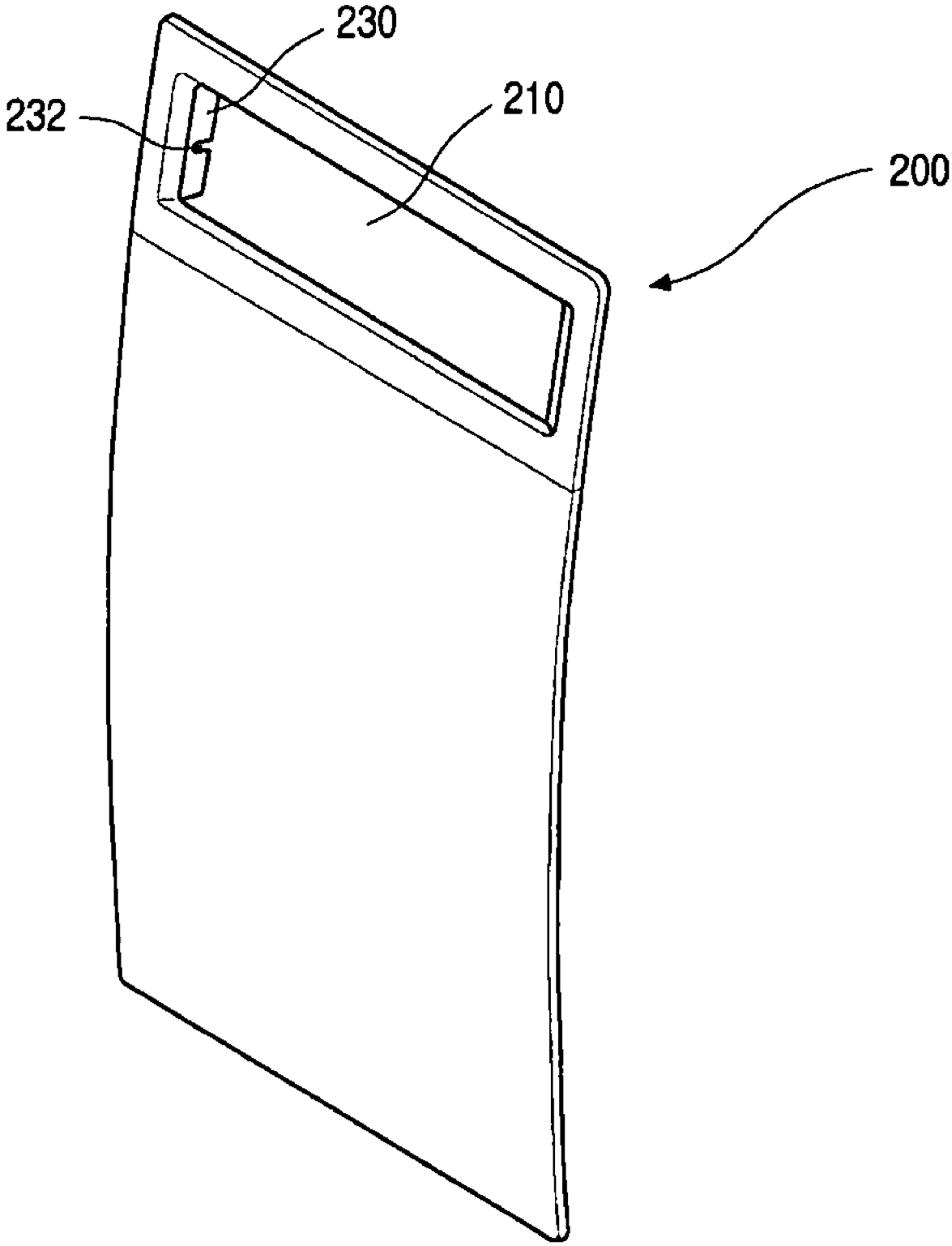
FIGS. 14 and 15 are front and rear perspective views of a front panel according to an embodiment of the present invention.
Figure 15:
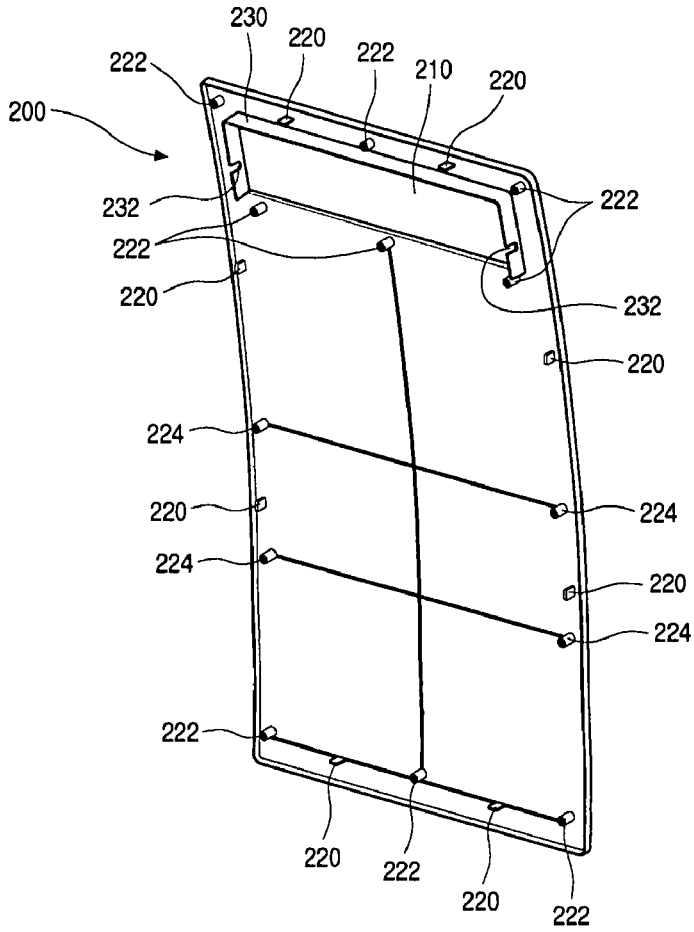

FIGS. 14 and 15 are a front perspective view and a rear perspective view of the front panel 200, respectively.

Referring to FIGS. 14 and 15, a plurality of panel hooks 220 protrude in a rear direction from a rear edge of the front panel 200. The panel hooks 220 have a shape corresponding to that of the plurality of panel hook holes 130 formed on the front frame 100, so that the panel hooks 220 are coupled to the panel hook holes 130. Therefore, a corresponding number of panel hooks 220 are formed on positions corresponding to positions where the panel hook holes 130 are formed, respectively. Also, the panel hooks 220 are formed in a '] ' shape (when seen from a lateral direction). That is, a front end of the panel hook 220 is formed to have a relatively greater cross-section, so that the panel hook 220 is not easily detached from the panel hook hole 130 once the panel hook 220 is inserted into the panel hook hole 130.

A plurality of panel coupling projections 222 are formed on a rear side of the front panel 200. The panel coupling projections 222 serve as a fixing means together with the panel coupling parts 132. The panel coupling projections 222 are formed on an upper side and a lower end of the front panel 200.

The panel coupling projections 222 are formed on positions corresponding to positions where the panel coupling parts 132 are formed. In detail, three panel coupling projections 222 are formed with a predetermined interval on each of upper and lower portions of the air outlet 210. Also, three panel coupling projections 222 are formed with a predetermined interval at a lower end of the front panel 200.

The panel coupling projections 222 are portions through and to which a coupling projection such as a screw passes and is coupled. Therefore, a screw groove to which a coupling projection such as a screw is screw-coupled is formed in the panel coupling projection 222.

An additional coupling projection 224 is further formed on a rear side of the front panel 200. The additional coupling projection 224 serves as an additional coupling means together with the additional coupling parts 134, and has the same shape as that of the panel coupling projection 222. Therefore, a coupling member that passes through the additional coupling part 134 is screw-coupled to the additional coupling projection 224.

A corresponding number of additional coupling projections 224 is formed on positions corresponding to positions of the additional coupling parts 134. That is, two additional coupling projections 224 are formed on each of left and right lateral ends on a central portion of the front panel 200.

A discharge fence 230 is formed along an edge of the air outlet 210. The discharge fence 230 protrudes to a rear side along the edge of the air outlet 210. The discharge fence 230 is a portion inserted into the louver installation opening 102 when the front panel 200 is coupled on the front frame 100.

An interference preventing groove 232 is formed to be open to a rear side in a lateral side of the discharge fence 230. The interference preventing groove 232 receives the louver rotational shaft 111 when the discharge fence 230 is inserted into the louver installation opening 102.

Figure 16:
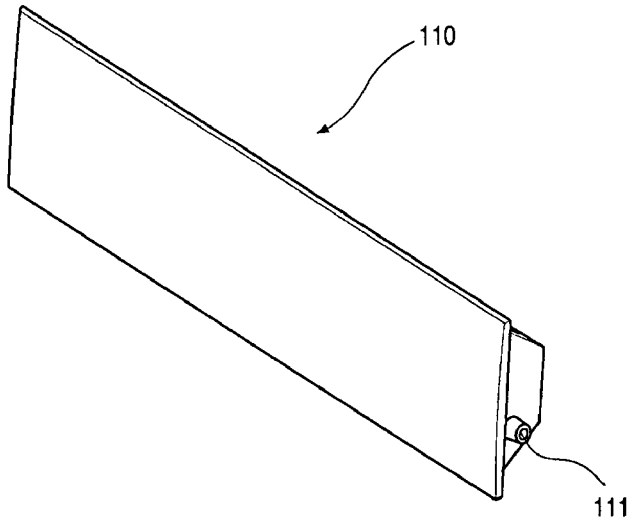
FIGS. 16 and 17 are front and rear perspective views of a discharge louver according to an embodiment of the present invention.
Figure 17:
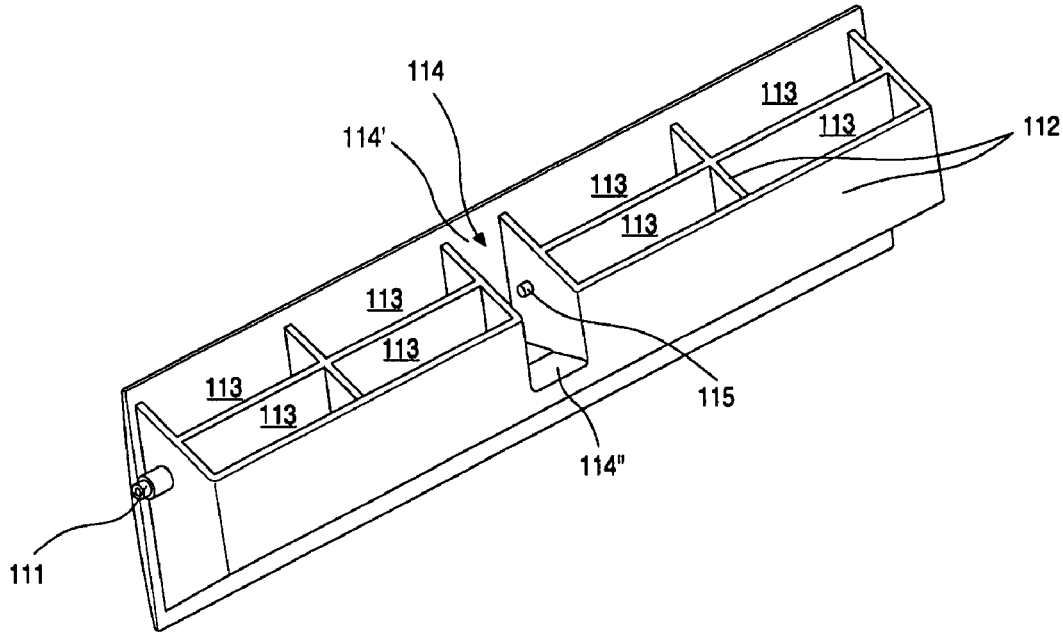

FIGS. 16 and 17 are a front perspective view and a rear perspective view of the discharge louver 110, respectively.

Referring to FIGS. 16 and 17, the louver rotational shafts 111 protrude in a lateral side from both sides of the discharge louver 110. The louver rotational shaft 111 serves as a center of rotation of the discharge louver 110, and is inserted into the louver installation groove 108 of the louver installation part 106.

A plurality of discharge ribs 112 are formed in a grating shape on the discharge louver 110 to constitute a plurality of discharge passages 113. Also, a louver center groove 114 that is open in a rear direction is formed in a central portion of the discharge louver 110. The louver center groove 114 is a portion that receives the louver support 150.

Therefore, as the discharge louver 110 rotates, the louver support 150 touches a groove front side 114' and a groove lower side 114" of the lover center groove 114 to limit a rotation range of the discharge louver 110.

A center support shaft 115 protrudes from a left side (a right side in FIG. 17) of the lower center groove 114. The center support shaft 115 is located on the same line as the louver rotational shaft 111 and inserted into the louver support hole 156 of the louver support 150.

Figure 18:
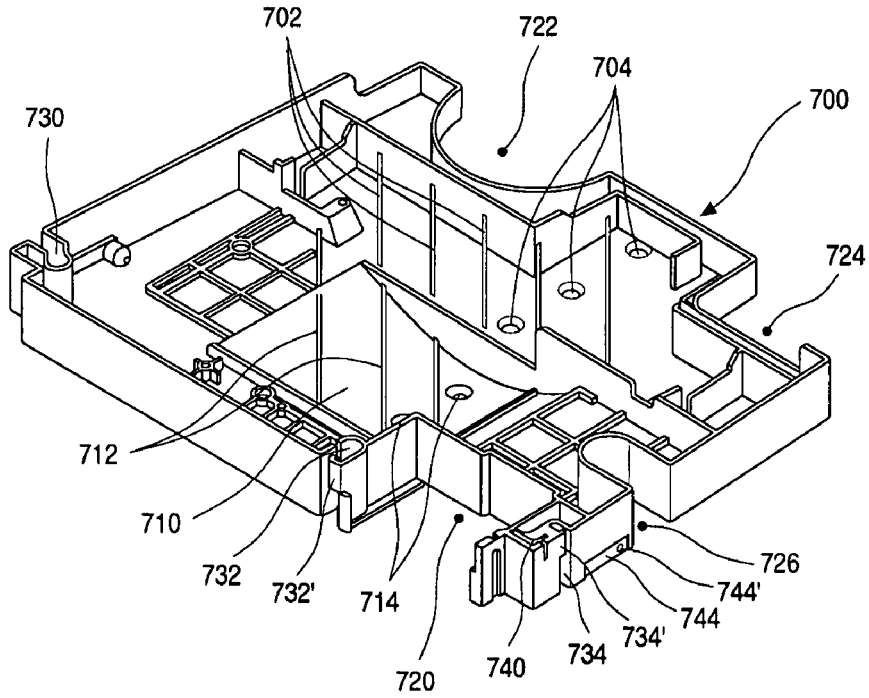
FIGS. 18 and 19 are upper and lower perspective views of a main drain pan according to an embodiment of the present invention.
Figure 19:
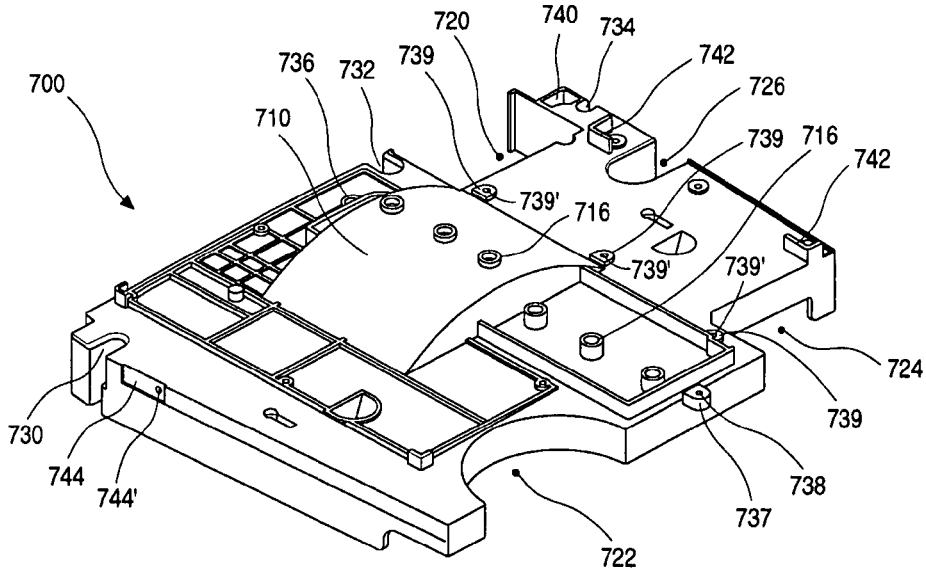

FIGS. 18 and 19 are perspective views illustrating an upper and lower constructions of the main drain pan 700, respectively.

Referring to FIGS. 18 and 19, as described above, the main drain pan 700 has a substantially quadrangle-shaped configuration, and is installed on a central portion between the front frame 100 and the rear frame 300 to divide a space formed by the front and rear frames 100 and 300 into an upper portion and a lower portion.

A plurality of bottom partition ribs 702 are formed on an upper surface of the main drain pan 700 as illustrated. The bottom partition ribs 702 allow a plurality of chambers to be formed on the upper surface of the main drain pan 700 so that spaces through which condensed water can flow.

In more detail, the plurality of bottom partition ribs 702 are formed on the upper surface of the main drain pan 700 with an equal interval. These bottom partition ribs 702 are integrally formed with the main drain pan 700, and protrude upward from the upper surface of the main drain pan 700.

The plurality of bottom partition ribs 702 allow a plurality of parts such as the second heat exchanger 860 installed above the main drain pan 700 not to closely contact the upper surface of the main drain pan 700, so that a predetermined space is formed. Accordingly, condensed water that has been generated from the second heat exchanger 860 and fallen down can easily flow on the upper surface of the main drain pan 700.

Meanwhile, the bottom partition ribs 702 are inclined at predetermined angles with respect to a front side and a lateral side of the main drain pan 700. That is, the bottom partition ribs 702 have a shape inclined to the left to guide flowing of condensed water.

A plurality of bottom condensed water holes 704 are formed in the main drain pan 700 to vertically pass through the main drain pan 700. The bottom condensed water holes 704 allow condensed water that has been generated from the second heat exchanger 860 and fallen down to move below the main drain pan 700.

A housing seat groove 710 recessed downward is further formed on a front half of the main drain pan 700. The housing seat groove 710 is intended for preventing interference with an upper fan housing 810 formed on the upper air guide 800. Therefore, the housing seat groove 710 is formed in an arc shape corresponding to a shape of a lower end of the upper fan housing 810, so that the lower end of the upper fan housing 810 is received in an upper side of the housing seat groove 710.

A plurality of groove partition ribs 712 are integrally formed with an equal interval on the housing seat groove 710. The groove partition ribs 712 are formed in a shape corresponding to a shape of the bottom partition ribs 702. Therefore, the groove partition ribs 712 are formed to be inclined to the left at a predetermined angel, and protrude upward from an upper surface of the housing seat groove 710. Also, groove condense water holes 714 are formed in the housing seat groove 710 to vertically pass through the housing seat groove 710. The groove condensed water holes 714 have the same shape as that of the bottom condensed water hole 704, and perform the same function.

Also, the plurality of groove condensed water holes 714 are formed in a lowermost end of the housing seat groove 710. That is, the groove condensed water holes 714 are formed in a lowest portion of the housing seat groove 710 that is substantially recessed and rounded downward and has a cross-section of an substantially arc shape (when seen from a front side). This is for swiftly draining condensed water collected in the housing seat groove 710 to a lower side.

Condensed water falling guides 716 are further formed on a lower surface of the main drain pan 700. The condensed water falling guides 716 allow condensed water moving to a lower side of the main drain pan 700 via the condensed water holes 704 and 714 to swiftly and directly fall down. That is, the condensed water falling guides 716 allow the condensed water that has moved to the lower side of the main drain pan 700 to directly fall down without flowing to other portions.

Therefore, the condensed water falling guides 716 protrude downward from a lower side of the main drain pan 700, and have a cylindrical shape. In more detail, the condensed water falling guides 716 extend downward from the condensed water holes 704 and 714. That is, the condensed water falling guides 716 extend downward from the bottom condensed water hole 704 and the groove condensed water hole 714, and are formed in a cylindrical shape corresponding to shapes of the condensed water holes 704 and 714.

Meanwhile, a plurality of grooves for avoiding interference with neighboring parts are formed in the main drain pan 700.

In more detail, a control box installation opening 720 is formed to be open on a front right end of the main drain pan 700. The control box installation opening 720 is formed in a size and a shape corresponding to a cross-section of the control box 870. Therefore, the control box 870 is installed vertically across the control box installation opening 720.

A duct avoiding groove 722 is formed to be open in a rear direction in a rear left portion of the main drain pan 700. The duct avoiding groove 722 is intended for avoiding interference with a lower end of the exhaust guide element 400. Therefore, the duct avoiding groove 722 has a semicircle shape corresponding to a front end of the exhaust guide element 400.

A working hole 724 is formed in a rear right portion of the main drain pan 700. The working hole 724 is a portion formed by cutting a rear right edge of the main drain pan 700 in a substantially 'L' shape. The working hole 724 is intended for easy working (e.g., after service) of an operator.

For example, the compressor 520 is installed below a right end of the main drain pan 700. The compressor 520 is covered with a protection cap (not shown). The working hole 724 is formed to allow an operator to easily mount the protection cap from an upper direction. A pipe passing groove 726 through which a coolant pipe (not shown) passes is formed in a right end of the main drain pan 700. That is, coolant flowing between the first heat exchanger 510, the compressor 520, and the second heat exchanger 860 flows via the coolant pipe formed of a pipe. This coolant pipe is vertically installed in the pipe passing groove 726. The pipe passing groove 726 is formed in a '⊂' shape (when seen from an upper direction) as illustrated.

A cord passing groove 730 is formed in a left front end of the main drain pan 700. The cord passing groove 730 is a groove through which a power cord (not shown) through which external power is applied, and a power line supplying power to the upper motor 820 pass. The cord passing groove 730 has a '⊃' shape (when seen from an upper direction).

A power line passing groove 732 is formed in a front end of the main drain pan 700. That is, the power line passing groove 732 is formed in a left side of the control box installation opening 720. The power line passing groove 732 is a portion through which various power lines supplied to the compressor 520 and the condensed water pump 550 pass.

The power line passing groove 732 is formed in a '∩' shape (when seen from an upper direction) as illustrated. A detachment preventing rib 732' for preventing the power line (not shown) inserted into the power line passing groove 732 from being detached to the front side is further formed at a front end.

An auxiliary groove 734 is further formed in the neighborhood of a right front end of the main drain pan 700. Like the power line passing groove 732, the auxiliary groove 734 is also intended for guiding a plurality of power lines. The auxiliary groove 734 is formed in a smaller size than that of the power line passing groove 732 to pass a DC power line therethrough.

The auxiliary groove 734 is formed in a '⊂' shape (when seen from an upper direction) as illustrated, and a DC line detachment preventing rib 734' is formed at a right end to prevent the power line from being detached.

Drain coupling parts 736, 737, and 739 for coupling with the sub-drain pan 750 are formed on the main drain pan 700. The drain coupling parts 736, 737, and 739 consist of a front drain coupling part 736 formed at a front end of the main drain pan 700, a rear drain coupling part 737 formed at a rear end of the main drain pan 700, and a right drain coupling part 739.

The front drain coupling part 736 is formed at a central front end of the main drain pan 700, and the rear drain coupling part 737 protrudes in a rear direction from a central rear end of the main drain pan 700. A drain coupling hole 738 through which a coupling member such as a screw passes is formed in central portions of the front drain coupling part 736 and the rear drain coupling part 737 to pass through the front drain coupling part 736 and the rear drain coupling part 737.

Three right drain coupling parts 739 are formed at a right portion of the main drain pan 700. That is, the right drain coupling parts 739 are formed at a rear end of the main drain pan 700, a right front end and a right rear end of the housing seat hole 710. A right drain coupling hole 739' like the drain coupling hole 738 is formed also in the right drain coupling part 739 to pass through the right drain coupling part 739.

An angle hole 740 is formed in a front right edge of the main drain pan 700. The angle hole 740 is a portion where a support angle 580 passes and is installed. Therefore, the angle hole 740 is formed in a '⌋' shape (when seen from an upper direction) corresponding to a cross-section of the support angle 580. The support angle 580 is inserted from above the angle hole 740.

Also, brace support parts 742 are formed at the neighborhood of a lower right end of the main drain pan 700. The brace support parts 742 are a portion to and on which an upper end of the brace 570 is coupled and supported, protrude downward (upward in FIG. 19) from a lower surface of the main drain pan 700, and are formed in a pair. That is, the brace support parts 742 are installed with a predetermined interval between them, and have a '⌊' shape and a '⌋' shape (when seen from an upper direction in FIG. 19) symmetric with each other as illustrated. Meanwhile, pan frame coupling parts 744 are formed in the neighborhood of left and right front ends of the main drain pan 700. The pan frame coupling parts 744 are formed on a position and in a shape corresponding to those of the pair of drain coupling members 144 formed on lateral sides of the front frame 100, and coupled to the drain coupling members 144, respectively.

Also, a frame coupling groove 744' is further formed in the pan frame coupling part 744. The frame coupling groove 744' is a screw groove to which a coupling member such as a screw is coupled. Therefore, when a screw passes through the drain coupling hole 144' of the front frame 100 and couples to the frame coupling groove 744', a front end of the main drain pan 700 is fixed to the front frame 100.

Figure 20:
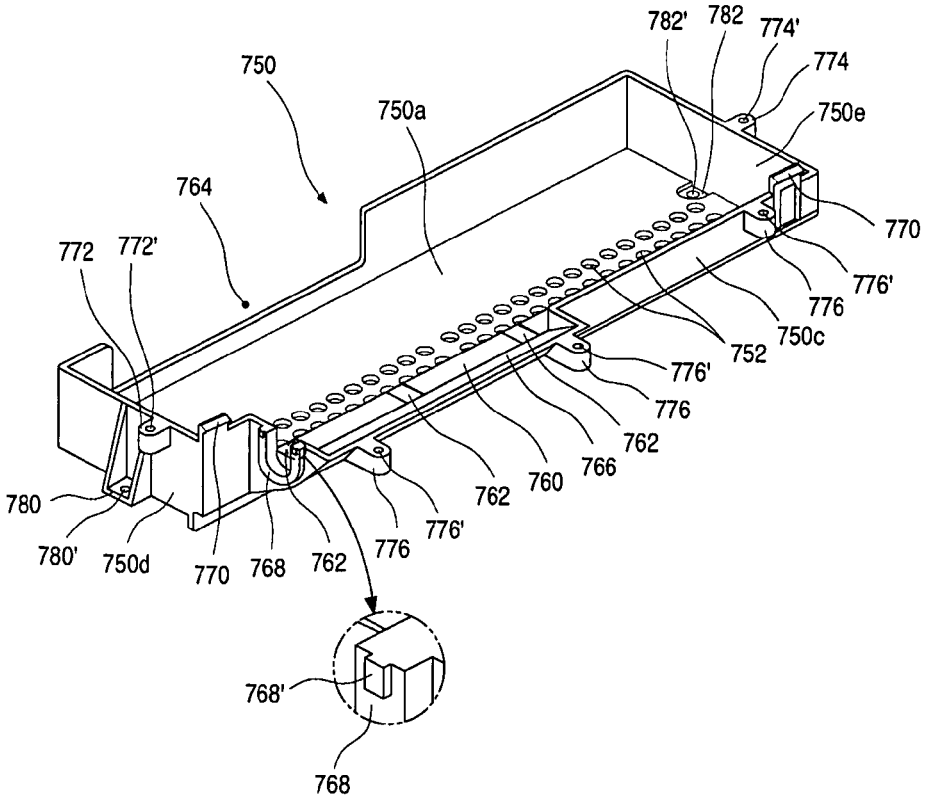
FIGS. 20 and 21 are upper and lower perspective views of a sub-drain pan according to an embodiment of the present invention.
Figure 21:
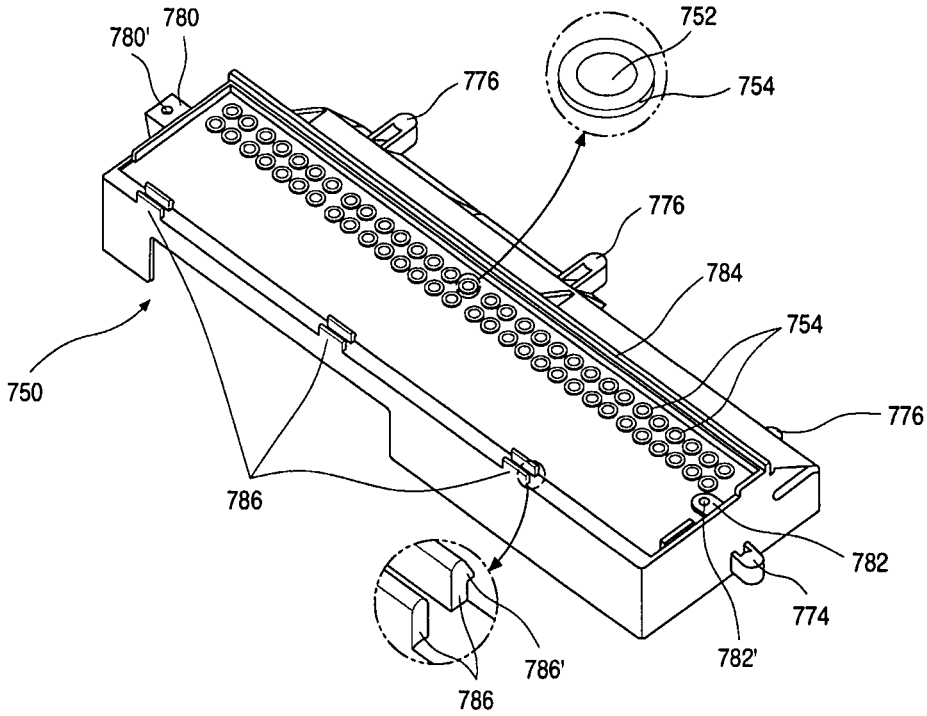

FIGS. 20 and 21 are an upper perspective view and a lower perspective view of the sub-drain pan 750, respectively. A construction of the sub-drain pan 750 will be described below in more detail.

As described above, the sub-drain pan 750 may be provided below the main drain pan 700 to collect condensed water generated at the first and second heat exchangers 510 and 860, and allows the collected and condensed water to fall down from the first heat exchanger 510.

Therefore, a plurality of falling holes 752 for allowing condensed water that has been collected to fall down to the first heat exchanger 510 are formed in the sub-drain pan 750. The falling holes 752 are formed in a circular shape and separated side by side with a predetermined interval.

The plurality of falling holes 752 are formed in a plurality of rows. That is, the plurality of falling holes 752 are formed in two rows that extend laterally to both ends of the sub-drain pan in a right portion of a bottom 750*a* of the sub-drain pan 750. Of course, the plurality of falling holes 752 can be formed in one row or three rows or more.

When the sub-drain pan 750 is installed, the plurality of falling holes 752 are located above the first heat exchanger 510. In more detail, the plurality of falling holes 752 are preferably located along a right upper side of the first heat exchanger 510. Therefore, condensed water falling downward via the plurality of falling holes 752 are evaporated while it flows down via a right surface of the first heat exchanger 510.

Falling guide ribs 754 are further formed on a lower surface of the sub-drain pan 750. The falling guide ribs 754 extend downward from a lower end of the falling holes 752 and are formed in a cylindrical shape having a predetermined length to guide falling of condensed water that has passed through the sub-drain pan 750 and moved to a lower side via the falling holes 750.

Meanwhile, the bottom 750*a* of the sub-drain pan 750 is formed to be inclined. That is, the bottom 750*a* has a predetermined slope whose height gradually reduces from a lateral end to the falling holes 752 to allow condensed water collected inside of the sub-drain pan 750 to be guided to the falling holes 752.

A right side of the sub-drain pan 750 is formed to have a height difference to constitute a drain guide surface 760. Therefore, the drain guide surface 760 is located at a relatively high position than that of the bottom 750*a* of the sub-drain pan 750. The drain guide surface 760 is a surface where condensed water collected on the base pan 500 is guided and flows into.

A plurality of drain guide grooves 762 are recessed downward from the drain guide surface 760. The drain guide grooves 762 are preferably formed with a predetermined interval to allow condensed water supplied to the drain guide surface 760 to easily flow to the bottom 750*a* of the sub-drain pan 750.

A bottom of the drain guide groove 762 is formed to be inclined to the left. That is, the bottom of the drain guide groove 762 has a slope whose height gradually reduces toward a direction in which the falling holes 752 are formed (a left side in FIG. 20). Therefore, flowing of condensed water is swiftly performed by this slope.

A drain avoiding hole 764 is formed in a left side 750*b* of the sub-drain pan 750. The drain avoiding hole 764 is formed by cutting off a portion of the left side 750*b* of the sub-drain pan 750. The drain avoiding hole 764 is intended for preventing interference with the housing seat groove 710 of the main drain pan 700 when the sub-drain pan 750 is coupled to the main drain pan 700.

A drain avoiding surface 766 is formed also on a right side 750*c* of the sub-drain pan 750 facing the drain avoiding hole 764. That is, a front half of the right side 750*c* is formed to be inclined to the right to constitute the drain avoiding surface 766. Like the drain avoiding hole 764, the drain avoiding surface 766 is also intended for avoiding interference with the housing seat groove 710.

A connector coupling part 768 is formed at a right front end of the sub-drain pan 750. The connector coupling part 768 is a portion to which one end of the condensed water pipe 560 is coupled, and has a 'U' shape whose upper direction is open.

Also, a connector fixing projection 768' protrudes to the front from a front upper end of the connector coupling part 768. The connector fixing projection 768' is a portion inserted into a connecting fixing groove 598. The connector fixing projection 768' fixes a pan connector 590 so that the pan connector 590 is not detached from the connector coupling part 768 once the pan connector 590 is coupled to the connector coupling part 768.

Drain hooks 770 are formed at a right front end and a right rear end of the sub-drain pan 750, respectively.

The drain hook 770 includes a general hook formed in a hook shape, and protrudes upward a predetermined distance from a right end of the sub-drain pan 750.

The drain hook 770 allows the sub-drain pan 750 to be primarily and provisionally assembled to the main drain pan 700. That is, when the drain hook 770 is inserted and coupled to a drain hook groove (not shown) formed in the main drain pan 700, the sub-drain pan 750 is primarily coupled to the main drain pan 700. A plurality of drain coupling projections 772, 774, and 776 are formed on the sub-drain pan 750 to allow the sub-drain pan 750 to be coupled to the main drain pan 700. Therefore, the drain coupling projections 772, 774, and 776 are formed at corresponding positions of the drain coupling parts 736, 737, and 739 of the main drain pan 700, respectively.

In more detail, the front drain coupling projection 772 and the rear drain coupling projection 774 protrude to the front and rear from upper ends of a front side 750*d* and a rear side 750*e* of the sub-drain pan 750, respectively. A front drain coupling groove 772' and a rear drain coupling groove 774' to which coupling projections are coupled are formed at a central portions of the front drain coupling projection 772 and the rear drain coupling projection 774, respectively.

Also, three right drain coupling projection 776 are formed on a right end of the sub-drain pan 750. A right drain coupling groove 776' to which a coupling member is coupled is formed in a central portion of each right drain coupling projection 776 to pass through the each right drain coupling projection 776.

Heat exchange coupling members 780 and 782 for coupling with the first heat exchanger 510 are formed on both sides of the sub-drain pan 750. That is, the front heat exchange coupling member 780 protrudes to the front from the front side 750*d* of the sub-drain pan 750, and the rear heat exchange coupling member 782 is formed at a rear end of the bottom 750*a* of the sub-drain pan 750. Also, a front heat exchange coupling hole 780' and a rear heat exchange coupling hole 782' through which coupling members can pass are formed in the front heat exchange coupling member 780 and the rear heat exchange coupling member 782, respectively. Also, a heat exchange support rib 784 is formed long lengthwise at a lower right end (a rear end in FIG. 21) of the sub-drain pan 750. The heat exchange support rib 784 protrudes downward a predetermined distance from a lower surface of the sub-drain pan 750 to contact a right upper end of the first heat exchanger 510. Therefore, the heat exchange support rib 784 supports the first heat exchanger 510 to prevent the first heat exchanger 510 from falling down. A plurality of orifice coupling ribs 786 are formed at a left end (a front end in FIG. 21) of the sub-drain pan 750. The orifice coupling ribs 786 are intended for allowing the sub-drain pan 750 and the lower orifice 600 to be coupled to each other.

The orifice coupling ribs 786 are a pair of ribs separated a predetermined distance, and a hooking threshold 786' is formed on one of the pair of the orifice coupling ribs 786. Therefore, when the orifice coupling rib 786 is inserted into an orifice coupling hole (not shown) formed in an upper surface of the lower orifice 600, the orifice coupling rib 786 is hooked at the hooking threshold 786' and not detached from the orifice coupling hole.

Figure 22:
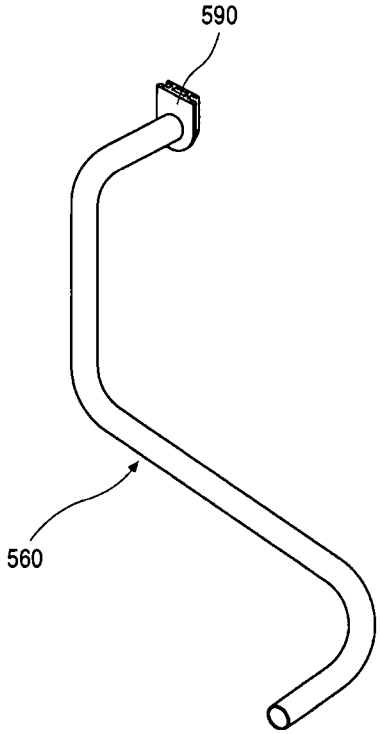
FIG. 22 is a perspective view illustrating a construction of a condensed water pipe according to an embodiment of the present invention.

FIG. 22 illustrates a perspective view of the condensed water pipe 560.

Referring to FIG. 22, the condensed water pipe 560 is formed to have a predetermined length, and installed between the condensed water pump 550 and the sub-drain pan 750 to guide condensed water.

Also, the condensed water pipe 560 is preferably formed of a flexible material so that the condensed water pipe 560 can be freely shaped. That is, the condensed water pipe 560 is formed of a rubber hose which can be transformed.

A lower end of the condensed water pipe 560 is coupled to the condensed water pump 550, and an upper end of the condensed water pipe 560 is detachably mounted on the sub-drain pan 750. That is, the upper end of the condensed water pipe 560 is detachably mounted at a front end of the sub-drain pan 750 using the pipe coupling means 590 and 768. The pipe coupling means 590 and 768 include the connector coupling part 768 and the pan connector 590.

Figure 23:
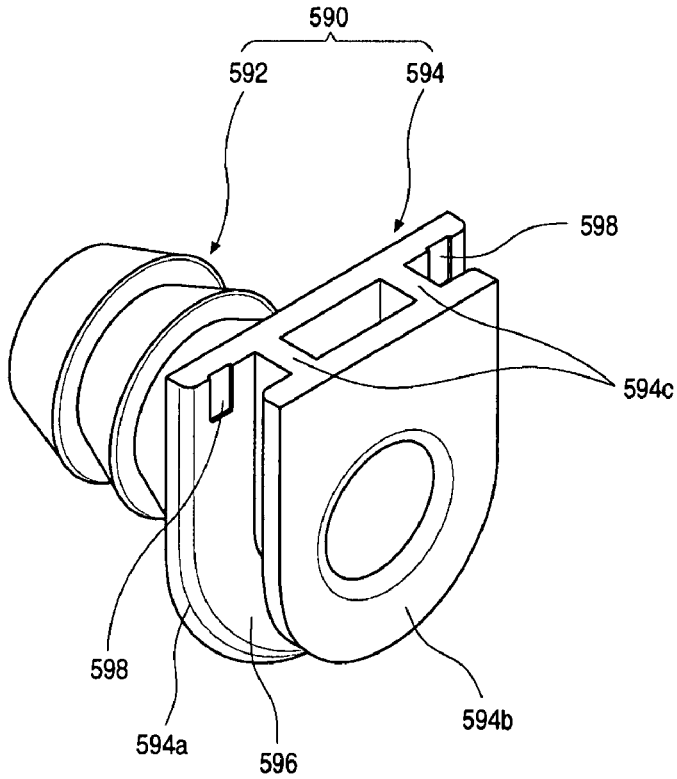
FIG. 23 is a perspective view illustrating a construction of a pan connector according to an embodiment of the present invention.

The pan connector 590 illustrated in FIG. 23 is fit on an upper end of the condensed water pipe 560. The pan connector 590 is mounted on the connecting coupling part 768 of the sub-drain pan 750 in a sliding manner, and serves as one element of the pipe coupling means 590 and 768. A detailed construction of the pan connector 590 will be described below in detail.

Figure 24:
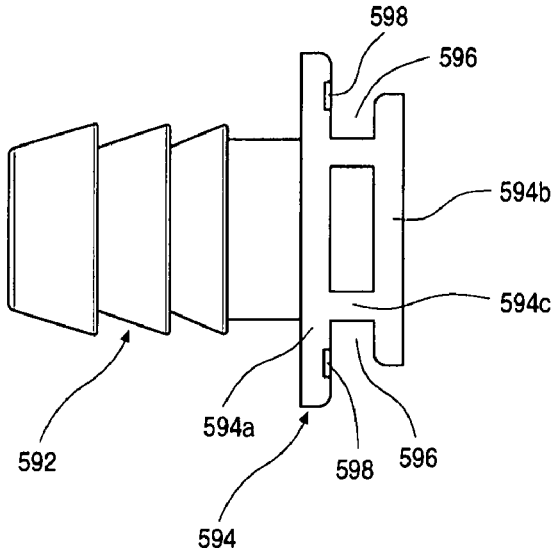
FIG. 24 is a plan view of the pan connector illustrated in FIG. 23.

FIGS. 23 and 24 are a perspective view and a plan view of the pan connector 590.

Referring to FIGS. 23 and 24, the pan connector 590 is formed in a shape corresponding to a shape of the connector coupling part 768 of the sub-drain pan 750, and coupled in a sliding manner.

In more detail, the pan connector 590 includes a pipe connecting member 592 coupled to an upper end of the condensed water pipe 560, and a pan coupling member 594 coupled to the connector coupling part 768.

The pipe connecting member 592 is formed in a shape corresponding to a shape of the circular condensed water pipe 560 and inserted into the condensed water pipe 560. Also, the pipe connecting member 592 is formed to have a cross-section of saw teeth so that the pipe connecting member 592 will not to be easily detached from the inside of the condensed water pipe 560 once inserted.

The pan coupling member 594 includes an outer plate 594*a* contacting one side of the connector coupling part 768, an inner plate 594*b* contacting the other side of the connector coupling part 768, and a connecting rod integrally connecting the outer plate 594*a* with the inner plate 594*b*.

The outer plate 594*a* and the inner plate 594*b* are formed in a semicircular shape, and the size of the outer plate 594*a* is greater than the size of the inner plate 594*b*. Also, the outer plate 594*a* contacts a front side (in FIG. 20) of the connector coupling part 768, and the inner plate 594*b* contacts a rear side (in FIG. 20) of the connector coupling part 768.

Referring to FIG. 23, the inner plate 594*b* is separated a predetermined distance from the outer plate 594*a*. Also, the connecting rod 594*c* may be provided between the outer plate 594*a* and the inner plate 594*b* separated the predetermined distance from each other.

Meanwhile, a connector groove 596 having a predetermined width is formed along an outer edge of the connecting rod 594*c*, i.e., between edges of the outer plate 594*a* and the inner plate 594*b*. Therefore, the connecting coupling part 768 is inserted into the connector groove 596.

The connector fixing groove 598 and connector fixing projection 768' prevent the pan connector 590 from being detached. The connector fixing groove 598 and connector fixing projection 768' are intended for preventing the fan connector 590 from being detached from the connector coupling part 768 once it is inserted into the connector coupling part 768. The connector fixing means consist of the connector fixing projection 768' and the connecting fixing groove 598 formed in a shape corresponding to a shape of the connector fixing projection 768'. The connector fixing groove 598 has a substantially quadrangular shape that is the same as a shape of the connector fixing projection 768', and is formed in a rear upper end (a front side in FIG. 23) of the outer plate 594*a*.

Figure 25:
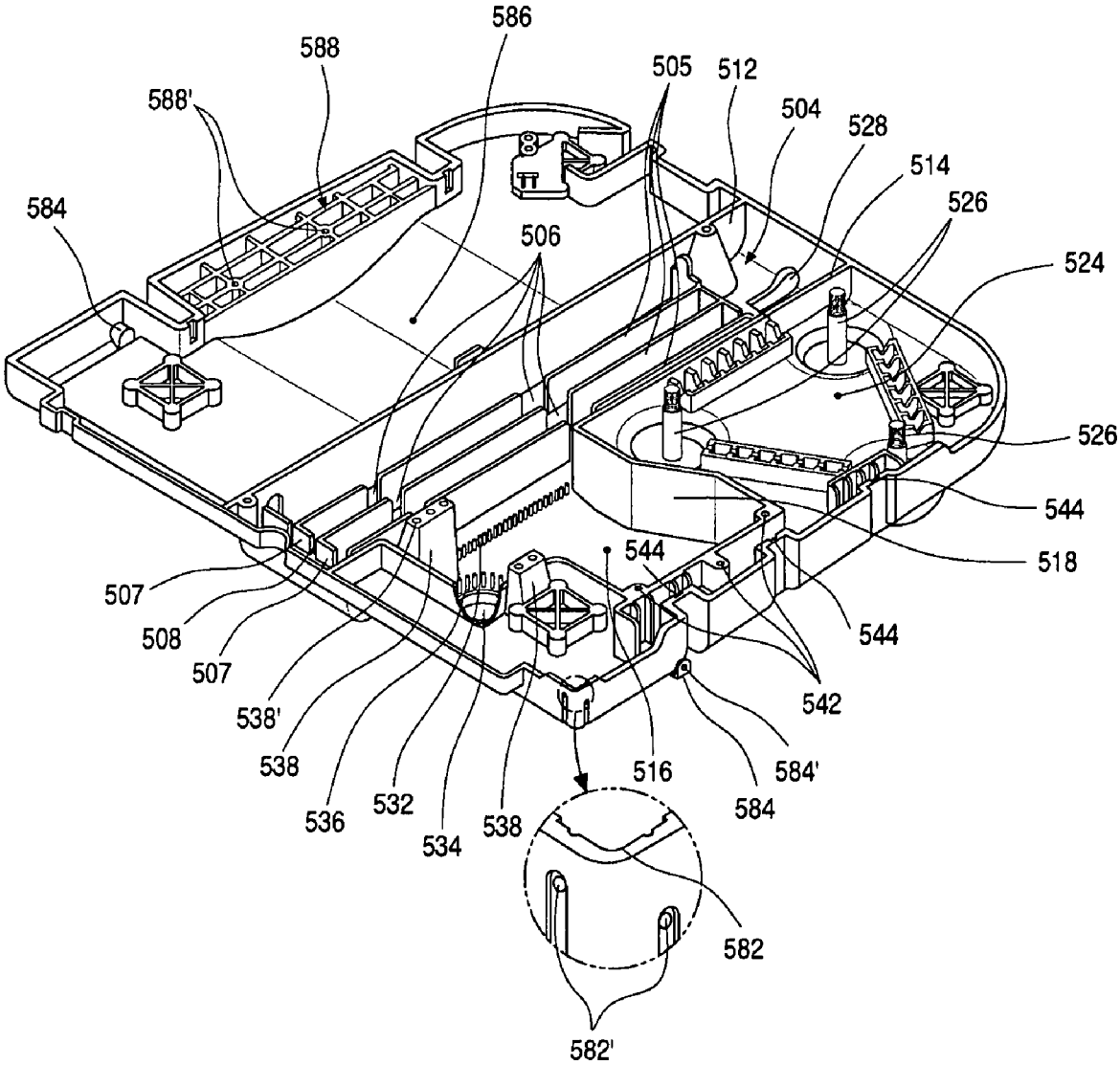
FIG. 25 is a perspective view of a base pan according to an embodiment of the present invention.

FIG. 25 illustrates a detailed construction of the base pan 500.

Referring to FIG. 25, a heat exchanger installation part 504 is formed on an upper surface of the base pan 500 in a lateral direction. The heat exchanger installation part 504 is formed along at a central portion of the base pan 500 in a lateral direction so that the first heat exchanger 510 is installed thereon. A plurality of partition support ribs 505 are integrally formed on the heat exchanger installation part 504. Since the plurality of partition support ribs 505 protrude upward in a predetermined size from the upper surface of the base pan 500, a predetermined space is formed between the base pan 500 and the first heat exchanger 510 by the partition support ribs 505 to allow condensed water to be swiftly collected and moved.

The plurality of partition support ribs 505 are formed long and extend in a back and forth direction. A plurality of base flow grooves 506 are formed in each of the partition support ribs 505. Portions of the partition support rib 505 are cut to form the base flow grooves 506. The base flow grooves 506 allow condensed water to move to left and right. Air blocking ribs 507 are formed at both ends of the partition support ribs 505 to prevent air from flowing. That is, the air blocking ribs 507 are formed at front ends and rear ends of the partition support ribs 505, respectively. The air blocking ribs 507 are perpendicularly bent from the front ends and the rear ends of the partition support ribs 505 to the right and extend a predetermined length to the right. Therefore, back and forth flowing of air through a space between the partition support ribs 505 is blocked by the air blocking ribs 507.

A condensed water flowing gap 508 is formed between a front end and a rear end of the air blocking rib 507 and the partition support rib 505. That is, a horizontal length of the air blocking rib 507 is smaller than an interval between the partition support ribs 505. Therefore, the condensed water flowing gap 508 is formed between a right end of the air blocking rib 507 and a left side of the partition support rib 505. The condensed water flowing gap 508 is intended for allowing condensed water to flow back and forth of the air blocking rib 507. Separation walls 512 and 514 for blocking left and right flowing of condensed water are formed at both sides of the heat exchanger installation part 504. Also, the separation walls 512 and 514 consist of a left separation wall 512 constituting a left boundary of the heat exchanger installation part 504, and a right separation wall 514 constituting a right boundary of the heat exchanger installation part 504.

The left separation wall 512 and the right separation wall 514 are formed to have a higher height than a height of the partition support rib 505. Therefore, condensed water that has fallen onto the upper surface of the base pan 500 along the first heat exchanger 510 cannot flow to left and right by the separation walls 512 and 514.

A bottom of the heat exchanger installation part 504 is formed to be inclined to the right. Therefore, condensed water collected to the heat exchanger installation part 504 moves to the right and flows to a water collecting space 516.

The water collecting space 516 of a predetermined size is formed in a right side of the heat exchanger installation part 504. The water collecting space 516 is a portion where condensed water that has fallen onto the upper surface of the base pan 500 is collected. In more detail, a water collecting wall 518 having an about '⊃' shape (when seen from an upper side) protrudes upward from a right front end of the base pan 500. Therefore, the water collecting space 516 of a predetermined size is formed inside the water collecting wall 518.

The water collecting wall 518 is integrally formed with the right separation wall 514. That is, a front half of the right separation wall 514 is cut. This cut portion contacts a left end of the water collecting wall 518. Therefore, the heat exchanger installation part 504 communicates with the water collecting space 516.

A first foreign substance blocking fence 532 for filtering foreign substances contained in condensed water flowing to the water collecting space 516 is formed at a left side of the water collecting space 516. That is, the first foreign substance blocking fence 532 extends along a left portion serving as an entry of the water collecting space 516. The first foreign substance blocking fence 532 is formed on a line extending from the right separation wall 514.

The first foreign substance blocking fence 532 includes a plurality of projections arranged in a row at an equal interval. That is, the first foreign substance blocking fence 532 includes a thin cylindrical projection arranged in a row with an equal interval. Therefore, foreign substances of a greater size than a distance between the cylindrical projections cannot pass through the first foreign substance blocking fence 532 and are filtered.

A water collecting groove 534 is formed in the base pan 500. The water collecting groove 534 is formed in a lower side where the condensed water pump 550 is installed and recessed downward from the upper surface of the base pan 500 to allow condensed water to be collected. In more detail, the water collecting groove 534 is formed in a front end of the water collecting space 516, and has a bottom deeper than that of the water collecting space 516.

Also, a second foreign substance blocking fence 536 is formed along an edge of the water collecting groove 534. In more detail, the second foreign substance blocking fence 536 is formed in a circular arc shape at a rear side of the water collecting groove 534. The reason the second foreign substance blocking fence 536 is formed at a rear side of the water collecting groove 534 is because a rear side of the water collecting groove 534 is open and condensed water flows from the rear side.

The second foreign substance blocking fence 536 filters foreign substances contained in condensed water flowing to the water collecting groove 534. Like the first foreign substance blocking fence 532, the second foreign substance blocking fence 536 includes a plurality of projections arranged in a row at an equal interval. Therefore, condensed water collected into the water collecting groove 534 from the heat exchanger installation part 504 is primarily filtered at the first foreign substance blocking fence 532, and then secondarily filtered at the second foreign substance blocking fence 536.

A pair of pump supports 538 protrudes upward from left and right of the water collecting groove 534. The pump supports 538 are formed in shapes symmetric with each other to support both ends of the condensed water pump 550. Therefore, a plurality of pump coupling grooves 538' to which screws are coupled are formed in an upper surface of the pump support 538.

A condensed water detecting unit 540 is installed in the water collecting space 516. Therefore, detector coupling grooves 542 for allowing the condensed water detecting unit 540 to be fixed using screws are formed in a right upper end of the water collecting wall 518.

A plurality of brace coupling grooves 544 are formed in a right upper end of the base pan 500. The brace coupling grooves 544 are screw grooves to which screws can be coupled. Therefore, a lower end of the brace 570 is inserted into the brace coupling groove 544 and fixed at a right end of the base pan 500 using screws.

An angle lower end mounting part 582 on which a lower end of the support angle 580 is mounted is formed at a corner of a right front end of the base pan 500. A lower end of the support angle 580 is installed to contact an inner surface of a right corner of the base pan 500. Angle coupling holes 582' for fixing the lower end of the support angle 580 using screws are formed to pass through the angle lower end mounting part 582.

Therefore, when screws pass through the angle coupling holes 582' from the outside and couple to the lower end of the support angle 580, the lower end of the support angle 580 is fixed to the base pan 500.

A front end of the base pan 500 is coupled to a lower end of the front frame 100. Therefore, frame fixing parts 584 coupled to the base coupling member 146 at a lateral lower end of the front frame 100 are formed on both sides of the base pan 500, respectively. That is, the frame fixing parts 584 are formed at positions, respectively, separated to a rear side a predetermined distance from left and right corners at a front end of the base pan 500. The frame fixing parts 584 are formed at positions corresponding to the base coupling member 146, and formed in a shape corresponding to the shape of the base coupling member 146.

Frame fixing grooves 584' to which screws are coupled are formed in the frame fixing parts 584, respectively. Therefore, when a screw passes through the base coupling hole 146' of the base coupling member 146 and is screw-coupled to the frame fixing groove 584', the base pan 500 and the front frame 100 are coupled to each other.

A housing base groove 586 for avoiding interference with the housing groove 640 is recessed downward from base pan 500. The housing base groove 586 is intended for avoiding interference with the housing groove 640 formed at the lower orifice 600 and the lower air guide 620, and is formed a left central portion of the left separation wall 512.

A motor support 588 is formed at a central portion at a left end of the base pan 500.

The motor support 588 is a portion on which a lower end of the lower motor support 670 is mounted. For this purpose, a plurality of support coupling grooves 588' are formed in the motor support 588 to allow the lower end of the lower motor support 670 to be fixed using screws.

A compressor installation part 524 is formed on a right portion of a rear half of the base pan 500. The compressor installation part 524 is a portion on which the compressor 520 is mounted. Accordingly, three compressor fixing bolts 526 are integrally formed on the compressor installation part 524. The compression frame 522 is fixed in the compressing fixing bolts 526.

Also, a condensed water draining groove 528 for draining condensed water to the outside is formed in the base pan 500. The condensed water draining groove 528 is formed in a rear end of the heat exchanger installation part 504 to pass through a rear side of the base pan 500. Therefore, condensed water collected on the upper surface of the base pan 500 can be drained to the rear side of the base pan 500 via the condensed water draining groove 528 by a user's selection.

An operation of the air conditioner having the above-described construction will be described below.

First, flowing of coolant and air in the air conditioner according to the present invention will be described.

Though the air conditioner can be used for cooling and heating, description will be made for the case where the air conditioner is used for cooling.

The first heat exchanger 510 serves as a condenser, and the second heat exchanger 860 serves as an evaporator. Also, coolant pipes (not shown) are connected between the compressor 520, the first heat exchanger 510, and the second heat exchanger 860 to guide flowing of coolant.

Therefore, when gas coolant from the compressor 520 is compressed to become coolant of high temperature and high pressure, and flows into the first heat exchanger 510, the first heat exchanger 510 exchanges heat with outside air to condense coolant.

After that, condensed coolant expands while it passes through an expansion valve (not shown), and flows into the second heat exchanger 860. The coolant that has flowed to the second heat exchanger 860 exchanges heat with outside air to evaporate. Therefore, the coolant becomes a gas state. At this point, liquid state coolant also remains, so that coolant in two phases is mixed and present actually.

The coolant passes through the accumulator 530 and is sent back to the compressor 520 to complete a circulation cycle of the coolant.

Figure 26:
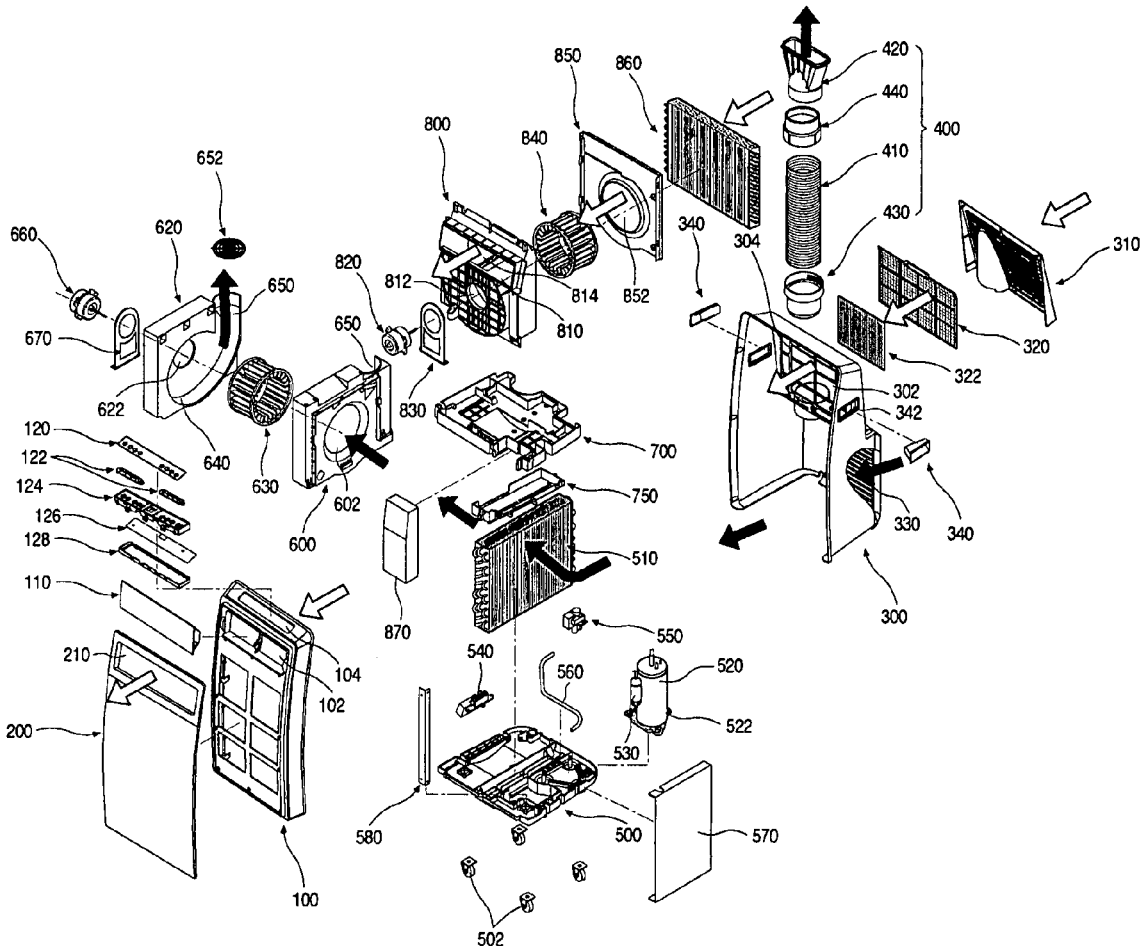
FIG. 26 is an air flow view illustrating air flows in an inside according to an embodiment of the present invention.

Meanwhile, air exchanges heat while it passes through the first and second heat exchangers 510 and 860. This process is described with reference to FIGS. 1, 2, and 26.

First, air flow (denoted by ⇦ in FIG. 26) at a heat sinking side (a lower side of the main drain pan) is described. The air flow at this point is basically generated by the lower fan 630. That is, when the lower motor 660 is driven by power applied from the outside, the lower fan 630 connected to a shaft of the lower motor 660 rotates to generate air flow.

Therefore, air from a rear side flows in via the lower grill 330 formed in a lower half of the rear frame 300. The air flowing to the front via the lower grill 330 changes its direction to flow to the left side and pass through the first heat exchanger 510.

Temperature of air that passes through the second heat exchanger 860 is raised. That is, since the second heat exchanger 860 serves as an evaporator, air receives heat from coolant flowing through the second heat exchanger 860 to become high temperature air The high temperature air that has passed through the second heat exchanger 860 passes through the lower orifice hole 602 to flow into a central portion of the lower fan 630. The air that has flowed into the central portion of the lower fan 630 flows radially as the fan 630 rotates, and is guided by the exhaust guides 650 and discharged upward.

High temperature air guided upward by the exhaust guides 650 is completely exhausted to an outside of a building via the exhaust guide element 400.

Next, air flow (denoted by ⬅ in FIG. 26) generated at a heat absorption side (an upper side of the main drain pan) is described. Air flow at this point is basically generated by the upper fan 840. That is, when the upper motor 820 is driven by power applied from the outside, the upper fan 840 connected to a shaft of the upper motor 820 rotates to generate air flow.

Therefore, air of an indoor space flows into the inside (the front side) via the suction grill 310 formed in an upper half of the rear frame 300. The air that flows in via the suction grill 310 sequentially passes through the pre-filter 320 and the deodorizer filter 322, so that foreign substances or bad smell contained in the air is removed.

The air that has passed through the pre-filter 320 and the deodorizer filter 322 exchanges heat with the second heat exchanger 860 while it passes through the second heat exchanger 860. That is, since the second heat exchanger 860 serves as an evaporator, air that passes through the second heat exchanger 860 is cooled down by exchanging heat with coolant flowing through the second heat exchanger 860.

Low temperature air that has passed through the second heat exchanger 860 flows to the front via the upper orifice hole 852 and flows into a central portion of the upper fan 840. The air that has flowed into the central portion of the upper fan 840 is discharged radially as the upper fan 840 rotates. The air is guided by the upper fan housing 810 to flow upward.

The air that flows upward by the upper fan housing 810 moves to the front via the discharge guide opening 814 of the upper air guide 800 to pass through the discharge louver 110. Low temperature air that passes through the discharge louver 110 is discharged to the front of the air outlet 210 to cool down an indoor space. Meanwhile, a direction of the air that passes through the discharge louver 110 can be changed by a plurality of ribs formed on the discharge louver 110.

Figure 27:
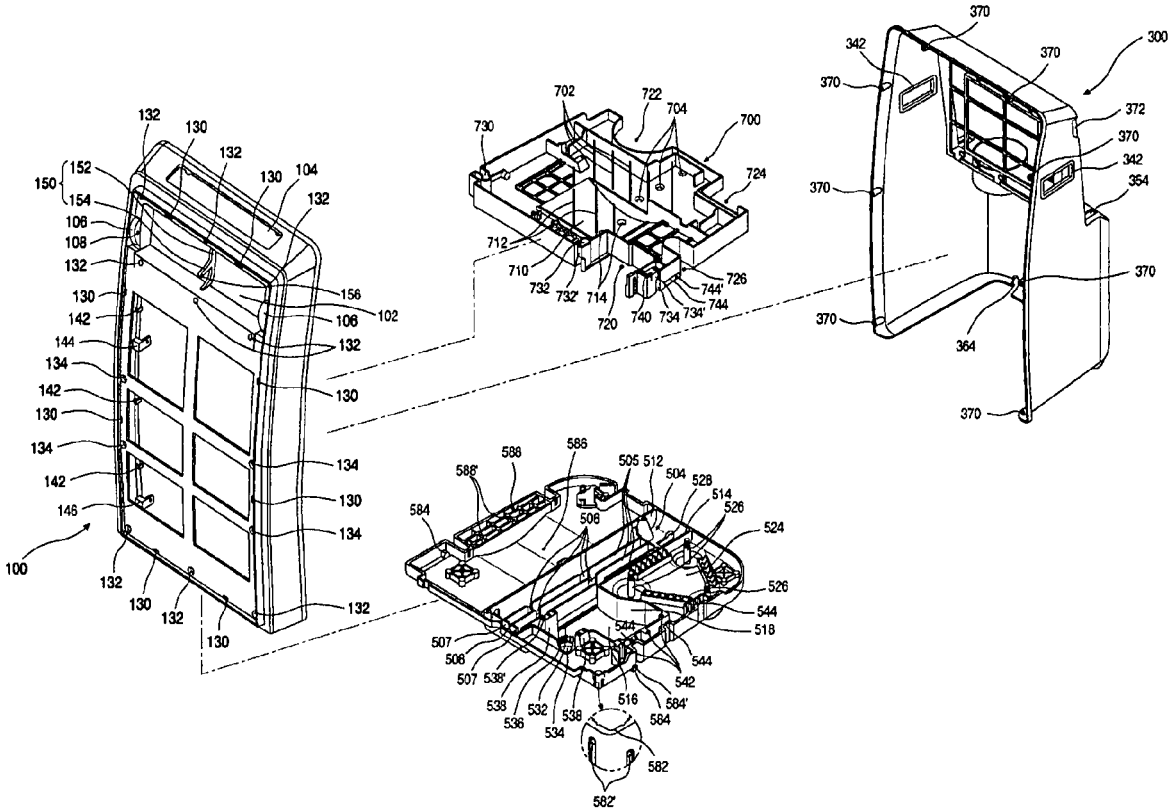
FIG. 27 is an exploded perspective view relations between a front frame, a rear frame, a base pan, and a main drain pan when they are installed.

FIG. 27 is a schematic exploded perspective view illustrating coupling relation between the rear frame 300, the base pan 500, and the main drain pan 700 that are coupled to the front frame 100.

When screws are inserted into the frame coupling projections 370 formed on left and right front ends and an upper front end of the rear frame 300, and coupled to the front frame 100, the rear frame 300 is coupled to the front frame 100.

Also, when screws pass through the base coupling members 146 of the front frame 100 and are screw-coupled to the frame fixing grooves 584', a front end of the base pan 500 is coupled to the front frame 100.

Also, when the screws pass through the drain coupling hole 144' of the front frame 100 and are screw-coupled to the frame coupling groove 744', a front end of the main drain pan 700 is fixed to the front frame 100.

Figure 28:
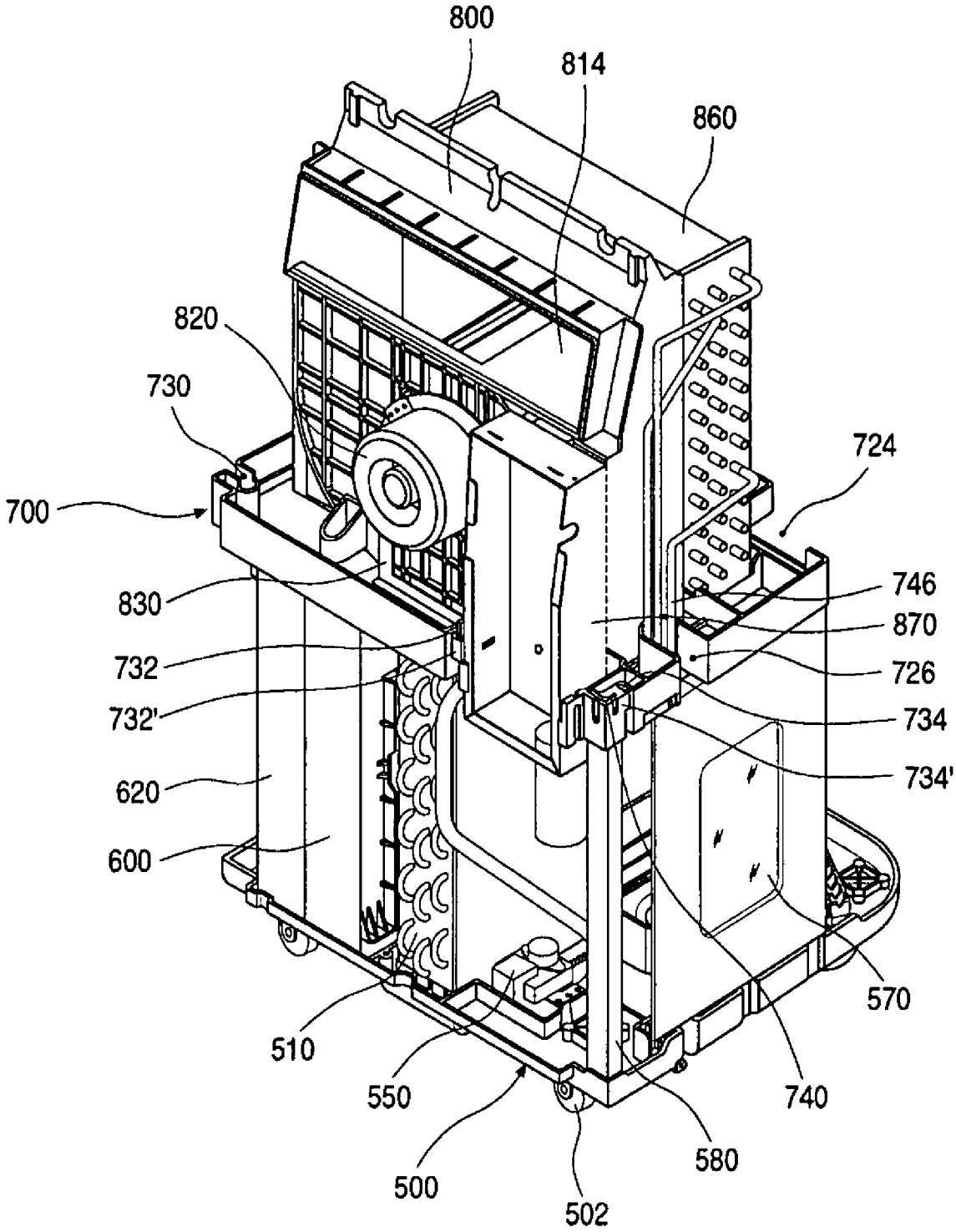
FIGS. 28 and 29 are front and rear perspective views of an inner construction according to an embodiment of the present invention.
Figure 29:
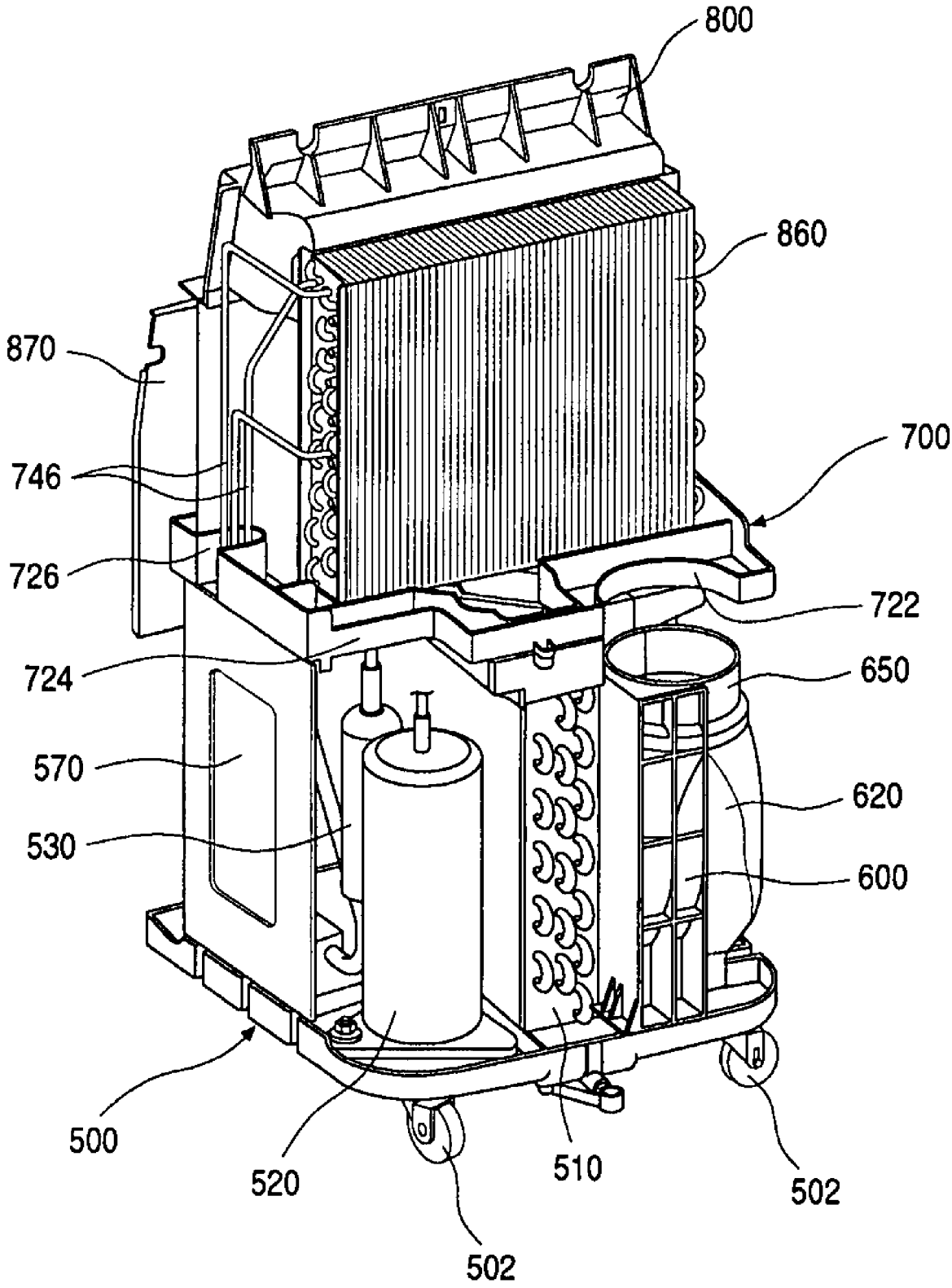

FIGS. 28 and 29 are perspective views illustrating an inner construction of the air conditioner according to the present invention.

Referring to FIGS. 28 and 29, the brace 570 is installed at a right end of the base pan 500 to support a right end of the main drain pan 700, and simultaneously, alleviate an impact when the compressor 520 falls down to the right.

Also, the support angle 580 is installed between a right front end of the main drain pan 700 and the base pan 500 to support the main drain pan 700. The support angle 580 is inserted from an upper direction of the angle hole 740.

In other embodiments, a suction duct for sucking air in a separated space can be further connected to the rear frame 300. That is, a duct such as the exhaust guide element 400 can be further provided to guide suction of air.

Also, though the support angle 580 is vertically installed on a right portion at a front end of the base pan 500 to support a front end load of the main drain pan 700 in the above embodiments, the support angle 580 can be vertically installed on a left portion at a front end of the base pan 500 or the support angle 580 can be vertically installed on a left and right portion at a rear end of the base pan 500.

Also, though condensed water collected on the main drain pan 700 flows down to the sub-drain pan 750 and is collected and then uniformly sprayed over an upper end of the first heat exchanger 510 and evaporated in the above embodiments, condensed water can be processed using other means. That is, a separate condensed water barrel can be provided below the sub-drain pan 750 to collect condensed water collected on the main drain pan 700 and drain the condensed water to the outside.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

a front frame providing a front portion;

a rear frame providing a rear portion;

a main drain pan dividing a space between the rear frame and the front frame, the main drain pan including an upper side and a lower side;

an evaporator provided at the upper side, for allowing heat exchange to occur between indoor air and coolant;

a condenser provided at the lower side, for allowing heat exchange to occur between outdoor air and coolant;

an indoor blower unit provided at the upper side, for generating intake and exhaust of indoor air;

an outdoor blower unit is provided at the lower side, for guiding airflow direction of air that is heat exchanged at the condenser; and a base pan providing a bottom portion, wherein the front frame is simultaneously coupled to the rear frame, the base pan, and the main drain pan, and wherein a frame coupling part and a frame coupling projection are formed in positions and in shapes corresponding to each other, wherein the frame coupling part and the frame coupling projection are coupled to each other at edges of the front frame and the rear frame, respectively.

2. The air conditioner according to claim 1, wherein a plurality of coupling guide ribs to which an edge of the rear frame is inserted are formed at a lateral rear end of the front frame.

3. The air conditioner according to claim 1, wherein a pair of drain coupling members and a pan frame coupling part are formed in positions and in shapes corresponding to each other and coupled to each other, the pair of drain coupling members and the pan frame coupling part being formed on the front frame and the main drain pan; and a drain coupling hole and a frame coupling groove coupled together and formed in the drain coupling member and the pan frame coupling part respectively.

4. The air conditioner according to claim 1, wherein a base coupling member and a frame fixing part are formed in positions and in shapes corresponding to each other and coupled to each other, wherein the base coupling member and the frame fixing part are formed on the front frame and the base pan respectively; and a base coupling hole and a frame fixing groove coupled together and formed on the base coupling member and the frame fixing part.

5. The air conditioner according to claim 1, wherein at least one of a support angle and a brace for supporting the main drain pan is installed between the main drain pan and the base pan.

6. An air conditioner comprising:

a front frame providing a front portion;

a rear frame providing a rear portion;

a main drain pan dividing a space between the rear frame and the front frame, the main drain including an upper side and a lower side;

an evaporator provided at the upper side, for allowing heat exchange to occur between indoor air and coolant;

a condenser provided at the below side, for allowing heat exchange to occur between outdoor air and coolant;

an indoor blower unit provided at the upper side, for generating intake and exhaust of indoor air;

an outdoor blower unit is provided at the below side, for guiding airflow direction of air that is heat exchanged at the condenser;

a front panel provided to a front side of the front frame as part of the front portion; and a discharge louver provided on one side of the front frame to control a discharge direction of air, wherein the front panel is coupled at multiple locations to the front frame, and wherein the front panel comprises a provisional assembling element for allowing the front panel to be provisionally assembled on the front frame, and the front frame comprises a fixing element for fixing the front panel on the front frame using a coupling member.

7. The air conditioner according to claim 6, wherein the provisional assembling element comprises a plurality of panel hooks and panel hook holes formed on the front panel and in the front frame, respectively, and formed in shapes corresponding to each other and coupled to each other.

8. The air conditioner according to claim 6, wherein the fixing element comprises a panel coupling part and a panel coupling projection which are formed on the front frame and the front panel, respectively, and which a coupling member passes through or couples to.

9. The air conditioner according to claim 6, wherein an additional coupling element selectively used depending on a weight of the front panel to allow the front panel to be fixed on the front frame is further provided to the front frame and the front panel.

10. The air conditioner according to claim 6, wherein the discharge louver is rotatably installed in a louver installation opening formed to pass through the front frame;

a louver support for supporting the discharge louver is provided to a central portion of the louver installation opening; and a stopper for limiting a rotating range of the discharge louver is formed on the louver support.

11. The air conditioner according to claim 10, wherein a discharge guide for guiding discharging of air is formed on an edge of the louver installation opening; an air outlet through which air is discharged, and an air outlet guide protruding to one side from an edge of the air outlet to guide air are formed in and on the front panel; and the air outlet guide and the discharge guide are installed to overlap each other.

12. The air conditioner according to claim 6, wherein a front glass formed of a transparent material, and an image sheet on which an image is printed are further provided on one side of the front panel.

13. An air conditioner comprising:

a front frame providing a front portion;

a rear frame providing a rear portion;

a main drain pan dividing a space between the rear frame and the front frame the main drain including an upper side and a lower side;

an evaporator provided at the upper side, for allowing heat exchange to occur between indoor air and coolant;

a condenser provided at the below side, for allowing heat exchange to occur between outdoor air and coolant;

an indoor blower unit provided at the upper side, for generating intake and exhaust of indoor air;

an outdoor blower unit is provided at the below side, for guiding airflow direction of air that is heat exchanged at the condenser;

a suction grill installed in the rear frame and serving as an entry through which air enters; and an exhaust guide element mounted in the rear frame to guide exhaust of air to an outside, the exhaust guide element communicates the inner space of the rear frame with outer space of the rear frame, wherein a duct receiving groove penetrated by the exhaust guide element is integrally formed in the suction grill.

14. The air conditioner according to claim 13, wherein the rear frame comprise a plurality of filters for removing one of foreign substances and odor contained in air entering through the suction grill.

15. The air conditioner according to claim 13, wherein a detachment rib for allowing the suction grill to be easily separated protrudes to a side direction from both sides at upper ends of the suction grill.

16. The air conditioner according to claim 13, wherein a detachment groove for preventing interference with a human body when the suction grill is detached is recessed inward from a lateral upper end of the rear frame.

17. The air conditioner according to claim 13, wherein a handle for allowing a user to easily move the air conditioner is detachably installed on one of the rear frame and the front frame.

18. The air conditioner according to claim 17, wherein the handle comprises:

a handle body for receiving fingers of a user;

a handle edge protruding along an edge of the handle body and contacting an outer portion of the rear frame or front frame; and a fixing rib formed on a position separated a predetermined distance from the handle edge, and positioned inside the rear frame or the front frame.

19. The air conditioner according to claim 17, wherein the handle body has a width increasing or decreasing toward one side.

* * * * *